US008326199B2

(12) United States Patent
Koshida et al.

(10) Patent No.: US 8,326,199 B2
(45) Date of Patent: Dec. 4, 2012

(54) IMAGE HEATING APPARATUS WITH ROTATABLE HEAT GENERATION MEMBER CAPABLE OF INDUCTION HEAT GENERATION BY A MAGNETIC FLUX

(75) Inventors: Kohei Koshida, Toride (JP); Daigo Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 12/684,342

(22) Filed: Jan. 8, 2010

(65) Prior Publication Data

US 2010/0178088 A1 Jul. 15, 2010

(30) Foreign Application Priority Data

Jan. 9, 2009 (JP) ..... 2009-003268

(51) Int. Cl.
*G03G 15/20* (2006.01)
*H05B 6/36* (2006.01)

(52) U.S. Cl. ..... 399/328; 219/672

(58) Field of Classification Search ..... 399/328, 399/335, 320; 219/216, 469–471, 619, 636, 219/672

See application file for complete search history.

(56) References Cited

U.S. PATENT DOCUMENTS

| | | | | |
|---|---|---|---|---|
| 5,247,336 | A * | 9/1993 | Mills, III | 219/216 |
| 7,200,354 | B2 | 4/2007 | Nakamoto et al. | |
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,609,991 | B2 | 10/2009 | Koshida | |
| 2007/0077104 | A1 * | 4/2007 | Hasegawa | 399/328 |
| 2007/0231026 | A1 | 10/2007 | Hayashi et al. | |

FOREIGN PATENT DOCUMENTS

| | | |
|---|---|---|
| JP | 2000-162913 | 6/2000 |
| JP | 2001-194940 | 7/2001 |
| JP | 2002-328550 | 11/2002 |
| JP | 2007-132993 | 5/2007 |

* cited by examiner

*Primary Examiner* — Susan Lee
(74) *Attorney, Agent, or Firm* — Fitzpatrick, Cella, Harper & Scinto

(57) ABSTRACT

An image heating apparatus for heating an image on a recording material, includes a rotatable heat generation member capable of induction heat generation by a magnetic flux; a coil, provided outside the heat generation member, for generating the magnetic flux for the induction heat generation; a movable magnetic core provided at a position opposed to the coil; a moving device for moving the magnetic core between a first position opposed to the coil and a second position which is more away from the coil than the first position; and an electroconductive member mounted at a position where a magnetic circuit is capable of being formed with the coil when the magnetic core is in the second position.

12 Claims, 25 Drawing Sheets

IMAGE HEATING APPARATUS WITH ROTATABLE HEAT GENERATION MEMBER CAPABLE OF INDUCTION HEAT GENERATION BY A MAGNETIC FLUX

FIELD OF THE INVENTION AND RELATED ART

The present invention relates to an image heating apparatus suitable as an image heating apparatus to be mounted in an image forming apparatus, such as a copying machine, a printer, a facsimile machine, and combinations of preceding apparatuses, which form images with the use of an electrophotographic, electrostatic, magnetic, or the like recording method. More specifically, it relates to an image heating apparatus which uses a heating system based on electromagnetic induction.

As an image heating apparatus, a fixing apparatus which permanently or temporarily fixes an unfixed image on recording medium, and a glossiness increasing apparatus which increases the glossiness of a fixed image on a recording medium by heating the fixed image, can be listed. Also can be listed as an image heating apparatus are an image heating apparatus, and the like, for quickly drying liquid (ink) in an image forming apparatus of the inkjet type, which forms an image with the use of liquid (ink) which contains dye or pigment.

As an image heating apparatus for heating an unfixed toner image on recording medium in an image forming apparatus, such as those mentioned above, a heating apparatus which employs a heat roller is widely in use. An image heating apparatus of this type has a fixation roller (heat roller) and a pressure roller, which rotate while remaining kept pressed against each other. It fixes (melts and permanently adheres) an unfixed toner image to the recording medium by applying heat and pressure to the toner image while conveying the recording medium, on which the unfixed toner is present, through the pressure nip between the fixation roller and the pressure roller. Generally speaking, a fixation roller is heated by a halogen lamp.

One of the means proposed as the means for heating the fixation roller of an image heating apparatus such as those described above is the method which heats the fixation roller by Joule heat, that is, the heat generated by generating an eddy current in the inductive heating portion of the fixation roller, by the magnetic field generated by an exciter coil.

This type of image heating means allows a heat source to be place very close to toner. Thus, one of its characteristic features is that it can reduce the length of the time necessary for the surface temperature of its fixation roller to reach the proper level for fixation after the activation of the image heating apparatus. Another of its characteristic features is that its heat transmission passage from its heat source to the toner is short and simple, and therefore, it is high in thermal efficiency.

However, in a case where a large number of small sheets of a recording medium are continuously conveyed through it for image heating, the so-called "out-of-paper-path temperature increase" occurs. That is, from across the portion of the peripheral surface of the fixation roller, which comes into contact with the recording medium (the portion which corresponds to the recording medium path), the heat of the fixation roller is transmitted to the recording medium. On the other hand, there is nothing to which the portions of the peripheral surface of the fixation roller, which do not come into contact with the recording medium (the portions which do not correspond to the recording medium path), can transmit heat. Thus, heat accumulates in these portions of the peripheral surface of the fixation roller, creating sometimes a large temperature level difference between the portion of the fixation roller, which corresponds to the recording medium path, and the portion of the fixation roller, which does not correspond to the recording medium path. Normally, the temperature of the recording medium path portion of the fixation roller is kept at a preset fixation level. Therefore, the temperature of the out-of-recording-medium-path portion of the fixation roller excessively increases. This is the so-called out-of-recording-medium-path temperature increase (which hereafter will be referred to simply as the out-of-path temperature increase).

As the out-of-path temperature increase occurs, the temperature of the adjacencies of the out-of-path portion of the fixation roller becomes very high, because heat is also generated by the skin effect of the exciter coil as a magnetic flux generating means, and the magnetic core itself generates heat due to hysteresis loss. Thus, a highly heat resistant resin is necessary to cover the wire for the exciter coil. Therefore, a fixing apparatus is restricted in terms of structure. Further, there occurs another problem that the temperature of the exciter coil exceeds its specific Curie temperature, and therefore, the magnetic core loses its magnetism.

According to the technology proposed in Japanese Laid-open Patent Application 2001-194940 in order to prevent the occurrence of the above-described problems, the magnetic core (a core made of a magnetic substance) is divided into multiple sections, in terms of the direction perpendicular to the recording medium conveyance direction, so that preset sections can be moved away from the exciter coil by a moving means. Thus, as the preset sections of the magnetic core are moved, the distance between the exciter coil and the preset sections of the magnetic core increases. Therefore, the magnetic circuit generated around the exciter coil by the magnetic core and the inductive heating generating member decreases in efficiency, reducing thereby the amount of generated heat. Thus, the out-of-path temperature increase is prevented. Therefore, the magnetic core and the exciter coil do not abnormally increase in temperature.

In recent years, however, demand is increasing for image heating apparatuses capable of handling various recording media. Thus, developing a countermeasure for the out-of-path temperature increase has become increasingly important. As the countermeasure, it is desired to further increase the distance between the exciter coil and magnetic core.

Further, it is desired to reduce the amount of the magnetic flux that leaks between the exciter coil and the magnetic core of a fixing apparatus, as the above-described structure is employed by the fixing apparatus.

SUMMARY OF THE INVENTION

The primary object of the present invention is to provide an image heating apparatus which is structured so that it can adjust (increase or decrease) the distance between its external coil and the external core, and yet, is significantly smaller than a conventional image heating apparatus, in the amount of magnetic flux that leaks through the gap between the external coil and the external core.

According to an aspect of the present invention, there is provided an image heating apparatus for heating an image on a recording material, the apparatus comprising: a rotatable heat generation member capable of induction heat generation by a magnetic flux; a coil, provided outside the heat generation member, for generating the magnetic flux for the induction heat generation; a movable magnetic core provided at a position opposed to the coil; a moving device for moving the magnetic core between a first position opposed to the coil and a second position which is farther away from the coil than the first position; and an electroconductive member mounted at a position where a magnetic circuit is capable of being formed with the coil when the magnetic core is in the second position.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 9 is a cross-sectional view of the fixing apparatus when its solenoid switch is on.

DETAILED DESCRIPTION OF THE PREFERRED EMBODIMENTS

Embodiment 1

(1) Image Forming Portion

Figure 4:
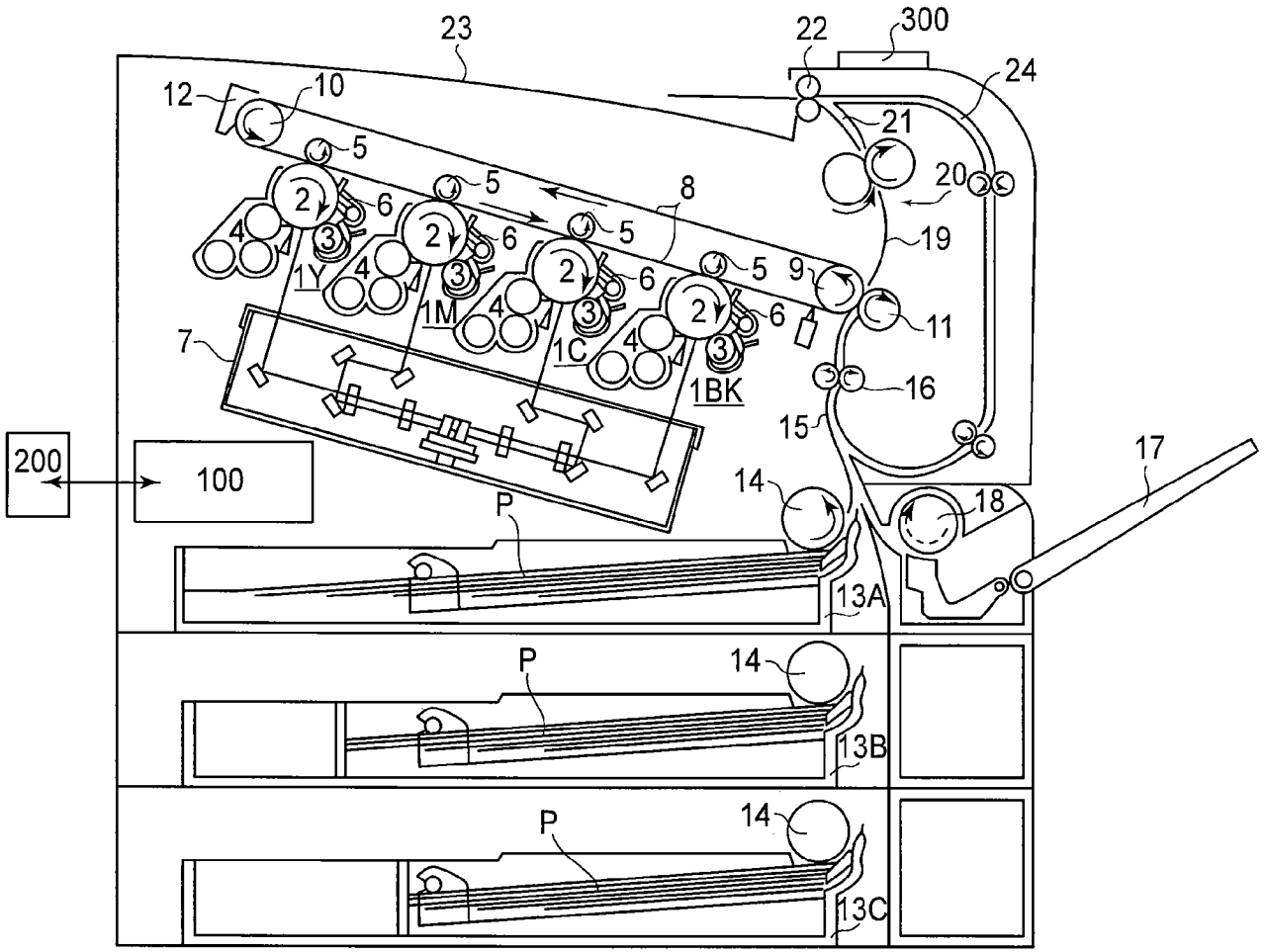
FIG. 4 is a schematic vertical sectional view of an example of an image forming apparatus, and shows the general structure of the apparatus.

FIG. 4 is a schematic vertical sectional view of an electrophotographic full-color printer, which is an example of an image forming apparatus having a fixing apparatus 20 which is an image heating apparatus in accordance with the present invention. It shows the general structure of the printer. First, the general structure of the image forming portion of the printer will be described.

This printer can output a full-color image. More specifically, it forms a full-color image on a recording medium according to the information of the image inputted from an external host apparatus 200 connected to a control circuit 100 (control chip: CPU) so that communication is possible between the printer and control circuit 100.

The external host apparatus 200 is a computer, an image reader, or the like. The control circuit 100 exchanges signals with the external host apparatus 200 and the control portion (panel) of the image forming apparatus. It exchanges signals also with various image forming devices, and controls the image formation sequence.

Designated by a reference numeral 8 is an intermediary transfer belt (which hereafter will be referred to simply as the belt 8), which is endless and flexible. The belt 8 is stretched between two rollers 9 and 10. The backup roller 9 opposes a secondary transfer roller. The roller 10 is a tension roller. As the roller 9 is driven, the belt 8 is circularly driven at a preset velocity in the direction indicated by an arrow mark. Designated by a reference numeral 11 is the secondary transfer roller, remaining pressed against the roller 9, with the presence of the belt 8 between the secondary transfer roller 11 and the backup roller 9. The nip between the belt 8 and secondary transfer roller 11 is the secondary transfer nip.

Designated by reference characters 1Y, 1M, 1C, and 1Bk are the first to fourth image forming portions, respectively, which are disposed below the belt 8, in a straight line, with preset intervals, a direction parallel to the moving direction of the belt 8. Each image forming portion is an electrophotographic processing mechanism, that uses an exposing method based on a laser, and has an electrophotographic photosensitive member 2 (which is in the form of a drum, and therefore, will be referred to simply as the drum 2 hereafter). The image forming portion also includes a primary charging device 3, a developing apparatus 4, a primary transfer roller 5, and a drum cleaning apparatus 6 in the adjacencies of the peripheral surface of each drum 2. Each primary transfer roller 5 is on the inward side of the loop of the belt 8, and is kept pressed against the corresponding drum 2, with the presence of the bottom portion of the belt 8 between the primary transfer roller 5 and drum 2. The interface between each drum 2 and the belt 8 is the primary transfer nip. Designated by a reference numeral 7 is an exposing apparatus which uses a beam of laser light as an exposure light. The exposing apparatus 7 is made up of a laser beam generating means, a polygonal mirror, a reflective mirror, etc. The laser beam generating means emits a beam of laser light in response to sequential pictural element signals, which are electrical digital signals given based on the information regarding the image to be formed.

The image forming operation of this image forming apparatus is started after the information, such as the size of the recording medium to be used, image data, the number of the copies to be formed, etc., is transferred from the external host apparatus, or a control panel 300, to the control circuit 100.

The control circuit 100 makes each image forming portion form an image in response to the image signals (which correspond to monochromatic images, into which an intended color image has been separated) inputted from the external host apparatus 200. Thus, yellow, magenta, cyan, and black color images are formed on the rotating drums 2 in the first to fourth image forming portions 1Y, 1M, 1C, and 1Bk, respectively, with preset control timing. Incidentally, since the principle and process of the electrophotographic image formation, that is, the principle based on which an image is formed, and the process in which an image is formed on each drum 2, are publicly known, they will not be described here.

The toner images formed on the drums 2 of the image forming portions, one for one, are sequentially transferred in layers (primary transfer) onto the outward surface of the belt 8, which is being circularly driven in the same direction as the rotational direction of the each drum 2, at a speed corresponding to the rotational speed of each drum 2. As a result, four monochromatic toner images, which are different in color, are placed in layers on the surface of the belt 8, synthetically creating an unfixed full-color toner image.

Meanwhile, the control circuit 100 makes the sheet feeding portion of the image forming apparatus feed a sheet of a recording medium, the size of which matches the recording medium size selection signal from the external host apparatus, or from the recording medium size selection signal inputting means of the control panel 300. More specifically, the main assembly of the image forming apparatus is provided with three recording medium feeder cassettes 13A, 13B, and 13C, which are vertically stacked in the main assembly of the image forming apparatus, and in which three sets of sheets of recording media different in size (width and/or length) are stored in layers, respectively. Each cassette 13A, 13B, 13C is provided with a feed roller 14. In response to the recording medium size selection signal, the feed roller 14 which corresponds to the selected recording medium size is driven with a preset timing, whereby one of the sheets of a recording medium is separated from the rest of the sheets of the recording medium in the cassette, and conveyed to a pair of registration roller 16 through a vertical recording medium sheet path 15 for the recording medium. In a case where the selected recording medium feeding method is the manually feeding method, a feed roller 18 is driven, whereby one of the layered sheets of recording media on a manual feeder tray 17 (multipurpose tray) is separated from the rest, and conveyed to the registration roller 16 through the vertical recording medium sheet path 15.

The registration rollers 16 begin to convey the recording medium sheet P with such a timing that the leading edge of the recording medium sheet P arrives at the second transfer portion at the same time as the leading edge of the abovementioned full-color toner image on the circularly moving belt 8 arrives at the second transfer portion. In the second transfer portion, therefore, the four monochromatic toner images, of which the single full-color image is made, are transferred all at once (second transfer) onto the surface of the recording medium sheet P. After being conveyed out of the second transfer portion, the recording medium sheet P is separated from the surface of the belt 8, and introduced into a fixing apparatus 20 (fixing device), which is an image heating apparatus, while being guided by a vertical guide 19. By this fixing apparatus 20, the four monochromatic toner images, different in color, are melted and mixed, and solidly fixed to the surface of the recording medium sheet P. After being moved out of the fixing apparatus 20, the recording medium sheet P is sent out, as a full-color copy, onto the delivery tray 23 by the pair of discharge rollers 22 through a recording medium conveyance path 21.

After the recording medium sheet P is separated from the surface of the belt 8 in the second transfer portion, the surface of the belt 8 is cleaned by the belt cleaning apparatus 12; the adherents (such as the toner particles remaining on the surface of the belt 8 after the second transfer) on the belt are removed by the cleaning apparatus 12 so that the surface of the belt 8 can be repeatedly used for image formation.

When the image forming apparatus is in the monochromatic black print mode, only the fourth image forming portion 1Bk is controlled to form images. When the image forming apparatus is operated in the two-sided print mode, the image forming apparatus is controlled in the following manner: After the formation of an image on the first surface of the recording medium sheet P, the recording medium sheet P is conveyed into the delivery tray 23 by the discharge rollers 22. However, just before the trailing edge of the recording medium sheet P goes through the interface between the pair of discharge rollers 22, the pair of discharge rollers 22 is reversed in rotation. Thus, the diection of travel of the recording medium sheet P is changed, and the recording medium is introduced into a reconveyance path 24. Then, the recording medium sheet P is conveyed to the pair of registration rollers 16 through the reconveyance path 24, being thereby placed in an upside-down orientation. Thereafter, the recording medium sheet P is conveyed through the second transfer portion, to the fixing apparatus 20, as it was when an image was printed on its first surface, and then, is sent out, as a two-sided copy, onto the delivery tray 23.

(2) Fixing Apparatus 20

In the following description of the fixing apparatus 20, the front side of the fixing apparatus 20, and the front side of each of the structural components of the fixing apparatus 20, are their side where the recording medium sheet entrance is present. Their rear side is the opposite side from the front side (where recording medium sheet exit is present). The left and right sides of the fixing apparatus 20, and the left and right sides of the structural components of the fixing apparatus 20, are their left and right sides when the fixing apparatus 20 is seen from its front side. Further, the lengthwise direction of the fixing apparatus 20 is the direction perpendicular to the recording medium conveyance direction, or the direction parallel to the lengthwise direction. The upstream and downstream sides are the upstream and downstream sides in terms of the recording medium conveyance direction. Further, the "recording medium size" or the "recording medium path width" means the recording medium sheet measurement in terms of the direction perpendicular to the recording medium conveyance direction.

Figure 1:
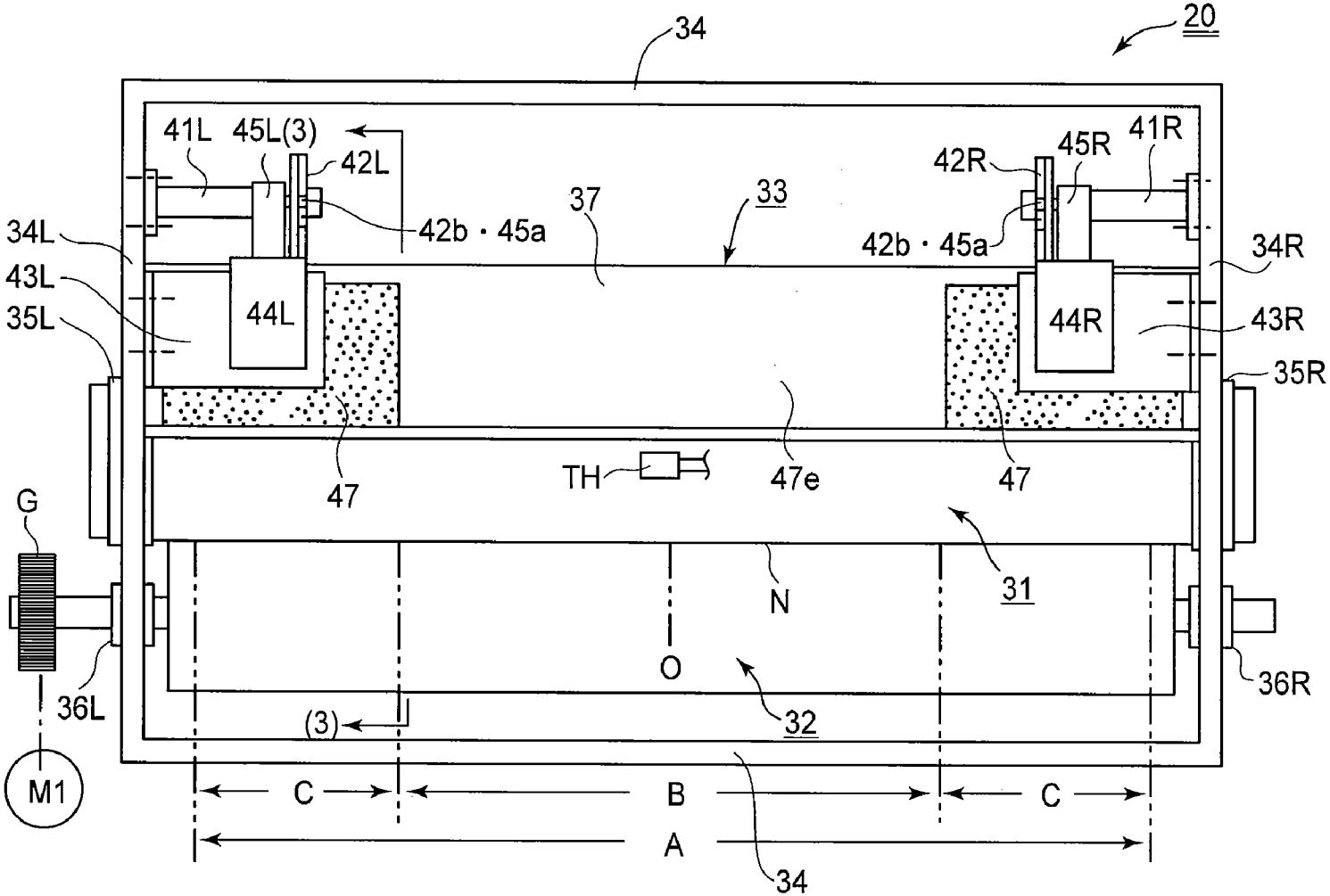
FIG. 1 is a schematic frontal view of the fixing apparatus in the first preferred embodiment of the present invention.
Figure 2:
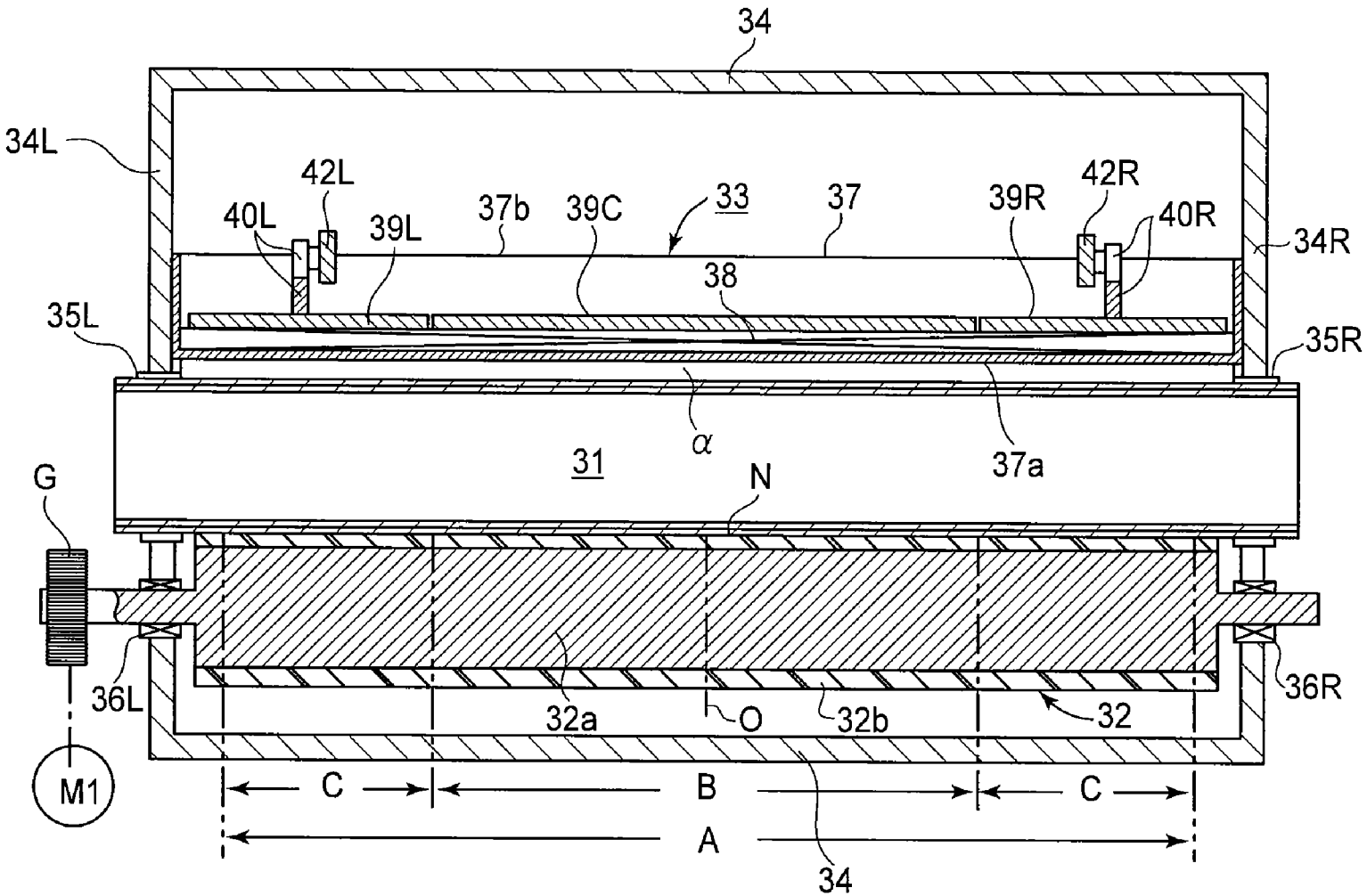
FIG. 2 is a schematic vertical sectional view of the fixing apparatus in the first preferred embodiment.
Figure 3:
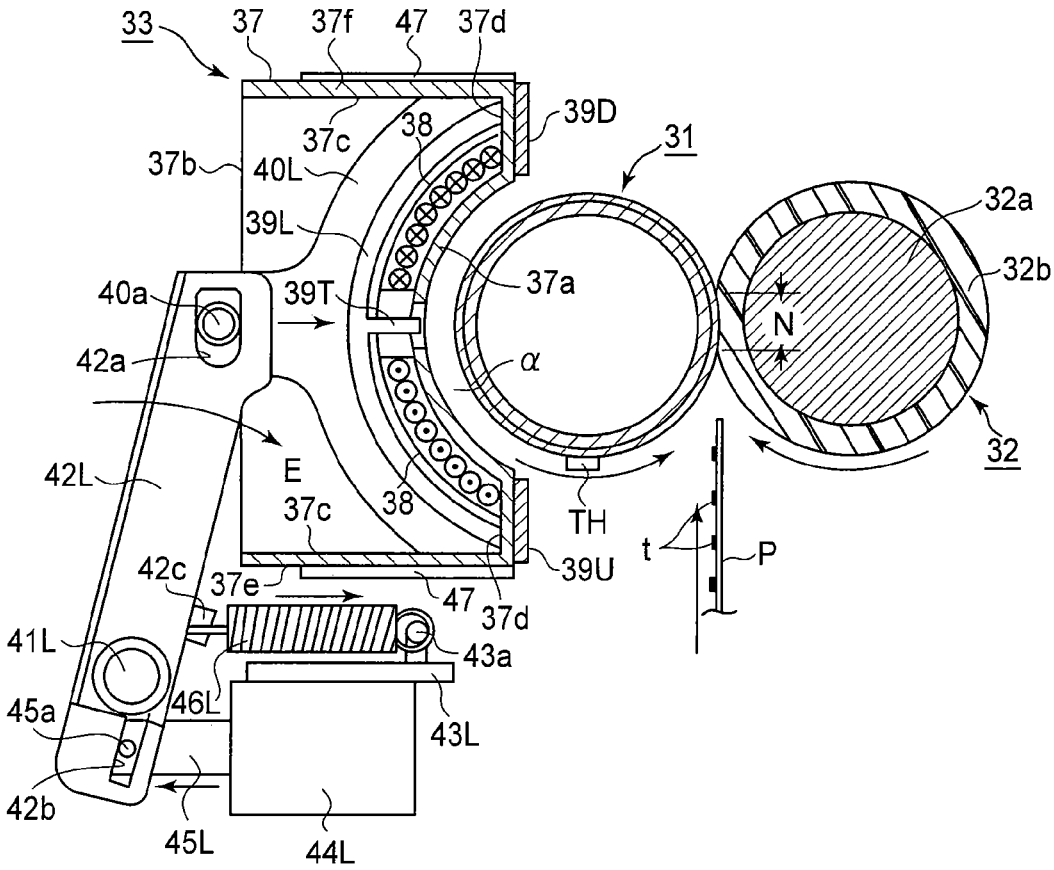
FIG. 3 is an enlarged schematic cross-sectional view of the left end portion of the fixing apparatus in FIG. 1, at a plane (3)-(3) in FIG. 1.

The fixing apparatus 20 in this embodiment is an image heating apparatus which uses an electromagnetic heating method. It has a magnetic flux generating means, which is outside the fixing member. FIG. 1 is a schematic front view of the fixing apparatus 20, and FIG. 2 is a schematic vertical sectional view of the fixing apparatus 20, at a plane parallel to the lengthwise direction of the fixing apparatus 20. FIG. 3 is an enlarged cross-sectional view of the left end portion of the fixing apparatus 20 in FIG. 1, at a plane (3)-(3) in FIG. 1.

This fixing apparatus 20 has: a fixation roller 31 (fixing member) as a heating member; a pressure roller 32 as a pressure applying member; and an exciter coil assembly 33 as a magnetic flux generating unit. The fixation roller 31 is rotatably supported by the left and right lateral plates 34L and 34R, respectively, of the main assembly frame 34 (chassis, frame), with the presence of the left and right bearings 35L and 35R between the fixation roller 31 and the left and right lateral plate 34L and 34R, respectively. The fixation roller 31 is made of a metal, such as iron, which is highly magnetic (high in magnetic permeability), so that it can confine as much as possible the magnetic flux generated by the magnetic flux generating means 33. That is, by being capable of increasing the magnetic flux density in the roller 31, eddy current can be generated in the surface layer of the metal, and thus, by using a highly magnetic metal as the material for the fixation roller 31, it is possible to make the fixation roller 31 efficiently generate heat. The fixation roller 31 in this embodiment is made up of a metallic roller, an elastic layer, and a separation layer (surface layer). The metallic roller, which is an inductive heat generating portion of the fixation roller 31, is the main portion of the fixation roller 31. The elastic layer is on the peripheral surface of the metallic roller, covering the entirety of the peripheral surface of the metallic roller. The separation layer is on the outward surface of the elastic layer, covering the entirety of the elastic layer.

The pressure roller 32 also is rotatably supported by the left and right lateral plates 34L and 34R, respectively, of the main assembly frame 34 (chassis, frame), with the presence of the left and right bearings 36L and 36R between the pressure roller 32 and the left and right lateral plate 34L and 34R, respectively. The pressure roller 32 is an elastic roller. It is made up of a metallic core 32*a* and an elastic layer 32*b*, the elastic layer 32*b* covering the entirety of the peripheral surface of the metallic core 32*a*. The fixation roller 31 and the pressure roller 32 are disposed in parallel to each other, and remain pressed against each other with a preset amount of pressure applied by a pressure applying means (unshown) against the elasticity of the elastic layer 32*b*. Thus, there is a nip N (fixation nip) between the fixation roller 31 and the pressure roller 32. The nip N has a preset width in terms of the recording medium conveyance direction. The fixing apparatus 20 has a drive gear G, which is attached to the left end of the metallic core 32*a* of the pressure roller 32.

The exciter coil assembly 33 is on the opposite side of the fixation roller 31 from the pressure roller 32, and between the left and right lateral plates 34L and 34R of the main assembly frame 34. It is solidly attached to the left and right lateral plate 34L and 34R by its left and right end portions. The exciter coil assembly 33 is disposed parallel to the fixation roller 31, with the presence of a preset gap a between the exciter coil assembly 33 and fixation roller 31. The exciter coil assembly 33 is an assembly made up by attaching an exciter coil 38, and a magnetic core assembly 39 (39C, 39L, 39R, 39T, 39U, and 39D), etc., to a housing 37 (casing). The exciter coil assembly 33 will be described later.

Figure 5:
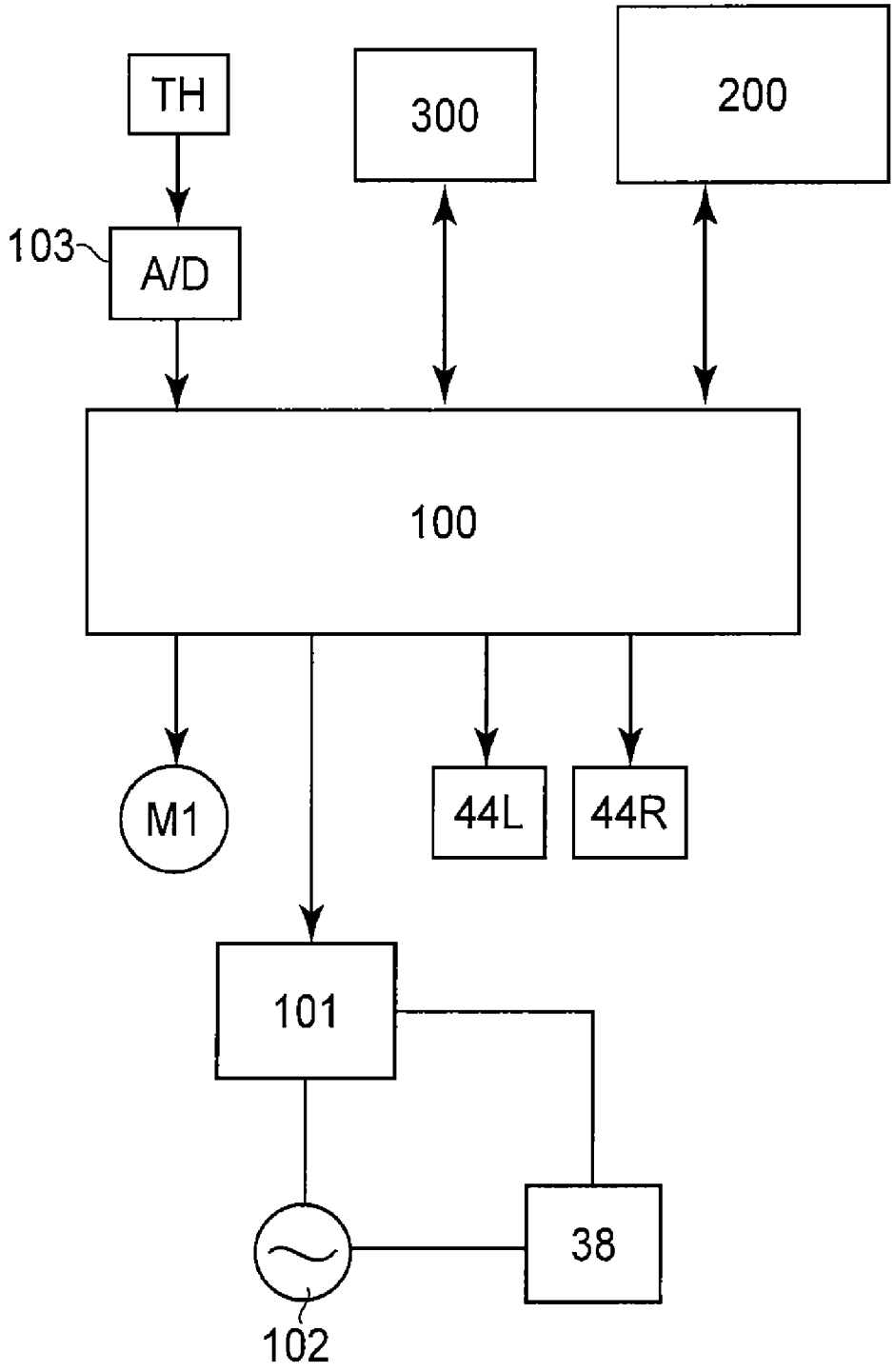
FIG. 5 is a block diagram of the control system of the image forming apparatus (fixing apparatus).

Next, referring to FIG. 5, which is a block diagram of the control system, the fixing operation of the fixing apparatus 20 will be described. The control circuit 100 begins to drive a fixation motor M1 with a preset control timing, in response to the image formation start signal inputted from the external host apparatus 200, or through the control panel 300. The driving force from the fixation motor M1 is transmitted to the drive gear G through the driving force transmission system (unshown). Thus, the pressure roller 32 is rotationally driven in the clockwise direction, indicated by an arrow mark, at a preset velocity. As the pressure roller 32 is rotated, the fixation roller 31 is subjected to the friction between the peripheral surface of the pressure roller 32 and the peripheral surface of the fixation roller 31, in the fixation nip N. Thus, the fixation roller 31 is rotated by the friction (from pressure roller 32) in the counterclockwise direction, indicated by another arrow mark, at roughly the same rotational speed as that of the pressure roller 32.

Further, the control circuit 100 turns on the exciter circuit 101 (circuit for driving electromagnetic induction heating means; high frequency converter). Thus, high frequency electric current flows from an AC power source 102 to the exciter coil 38 of the exciter coil assembly 33. Thus, the metallic substrate (electrically conductive layer of the fixation roller 31 is heated by the electric current generated by the magnetic field generated by the exciter coil 38. Thus, the fixation roller 31 increases in temperature. That is, as the exciter coil 38 is supplied with the alternating electric current from the exciter circuit 101, it generates alternating magnetic flux. The alternating magnetic flux is guided to the magnetic core assembly 39 (39C, 39L, 39R, 39T, 39U, and 29D), and acts on the fixation roller 31 (which is an inductive heating member), generating eddy current in the fixation roller 31. This eddy current generates Joule heat because of the presence of the specific resistance of the inductive heating member (fixation roller 31). In other words, the fixation roller 31, which is an inductive heat generating member, is made to inductively generate heat by the magnetic flux generated by supplying the exciter coil 38 with the alternative current. The surface temperature level of the fixation roller 31 is detected by the thermistor TH, which is a temperature detecting means. The electrical information regarding the surface temperature level of the fixation roller 31, which is outputted from the thermistor TH, is inputted into the control circuit 100 through the A/D converter 103. Based on the detected level of the surface temperature of the fixation roller 31, which is sent from the thermistor TH, the control circuit 100 controls the exciter circuit 101 so that the surface temperature of the fixation roller 31 increases to the target level, and remains at the target level. That is, the control circuit 100 controls the amount of electric power supplied from the AC power source 102 to the exciter coil 38.

The pressure roller 32 is rotationally driven as described above, and the fixation roller 31 is rotated by the rotation of the pressure roller 32. As the fixation roller 31 begins to be rotated by the rotation of the pressure roller 32, its temperature is increases to the preset level, and is kept at the preset level. Then, the recording medium sheet P, which has an unfixed toner image t, is introduced into the fixation nip N, with the recording medium sheet surface having the toner image t facing the fixation roller 31. Then, the recording medium sheet P is conveyed through the fixation nip N while remaining airtightly in contact with the peripheral surface of the fixation roller 31. Thus, the heat from the fixation roller 31, and the internal pressure of the fixation nip N, is applied to the recording medium sheet P, and the toner image t thereon. Thus, the unfixed toner image t on the recording medium sheet P becomes fixed, as a solid image, to the surface of the recording medium sheet P. After being conveyed through the fixation nip N, the recording medium sheet P is separated from the outward surface of the belt 8 while it is conveyed out of the fixing apparatus 20.

As for the positioning of the recording medium sheets P of large size, small size, or the other sizes, relative to the image forming apparatus and its fixing apparatus in this embodiment, the recording medium sheet P is conveyed in such a position that its center in terms of the widthwise direction aligns with the center of the recording medium passage in terms of its widthwise direction. The position designated by a reference character O in FIG. 1 is the reference center line (hypothetical line). Designated by a reference character A is the path of the largest recording medium sheet P (which hereafter may be referred to as large size recording medium sheet P) which is usable with (passable through) the fixing apparatus (image forming apparatus), and designated by a reference character B is the path of the small recording medium sheet P (which hereafter may be referred to as the small size recording medium sheet P) which is smaller in width by a certain amount than the largest size recording medium sheet P. Designated by a reference character C is one of the two recording medium sheet passage areas between the large size recording medium sheet path and small size recording medium path ((A−B)/2). That is, it is the width of one of the areas of the recording medium passage (fixation nip N), with which a recording medium sheet does not come into contact, if the recording medium sheet is of the small size (B). Here, the large size recording medium sheet P includes any recording medium sheet P, the width of which is less than the large recording medium path A, but, greater than B. Further, the small size recording medium sheet P includes any recording medium sheet P, the width of which is less than the small recording medium path B, but, greater than the width of the smallest size recording medium sheet usable (passable) with the fixing apparatus.

The thermistor TH of the fixation roller 31 is disposed in contact with, or in the adjacencies of, the portion of the peripheral surface of the fixation roller 31, which corresponds to the path of the small recording medium sheet. In this embodiment, the thermistor TH is disposed in the position which corresponds to the reference character O. Incidentally, the thermistor TH may be disposed in contact with the inward surface of the fixation roller 31, so that its position corresponds to the path of the small size recording medium sheet.

(3) Exciter Coil Assembly 33

Figure 6:
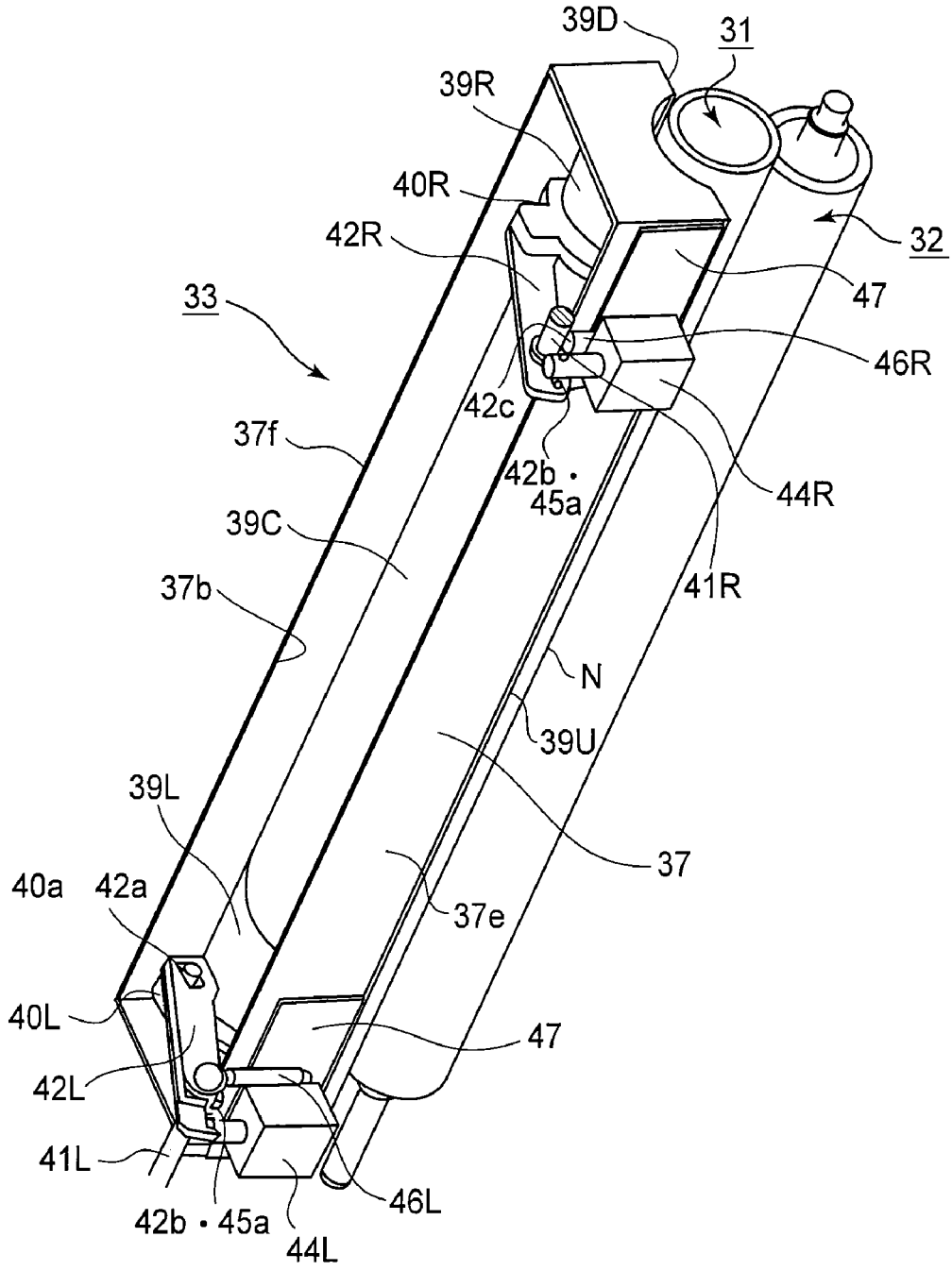
FIG. 6 is a perspective view of the fixation roller, the pressure roller, and the exciter coil assembly, as seen from the recording medium entrance side of the fixing apparatus.
Figure 7:
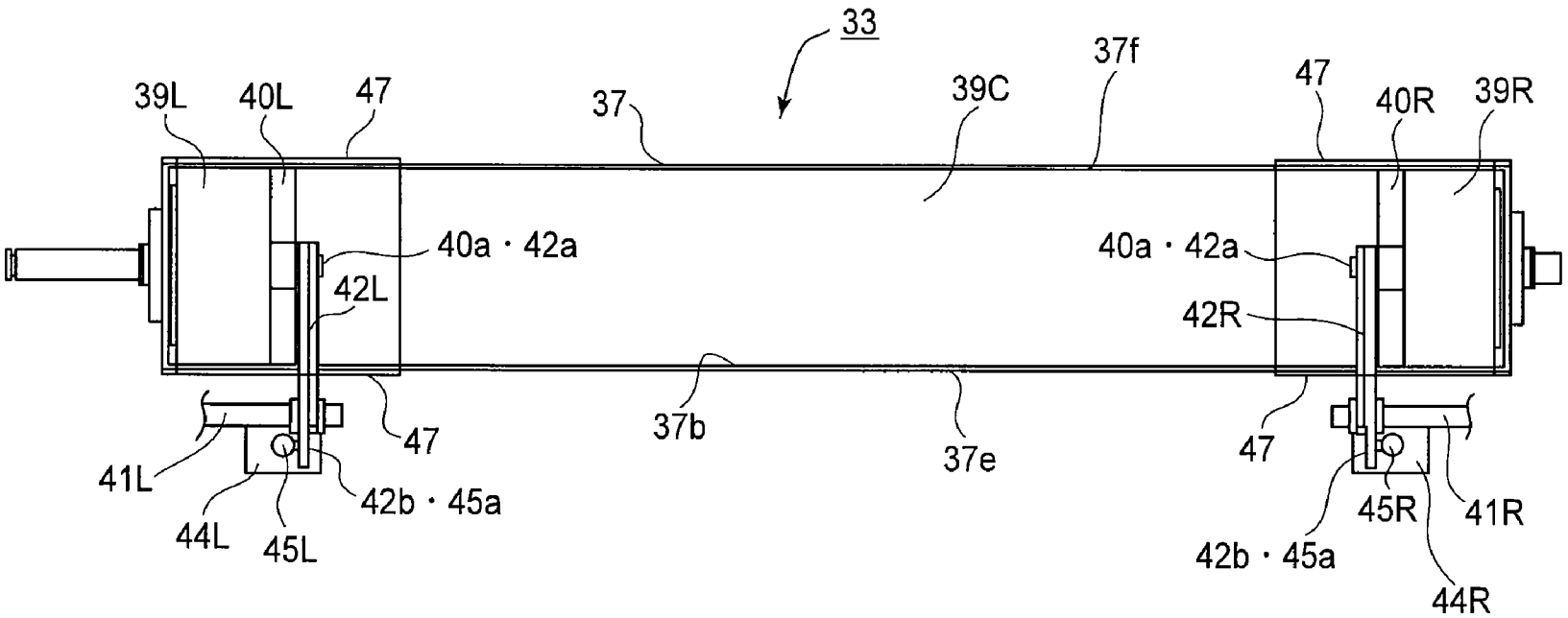
FIG. 7 is a plan view of the exciter coil assembly, as seen from the opposite side from the fixation roller.
Figure 8:
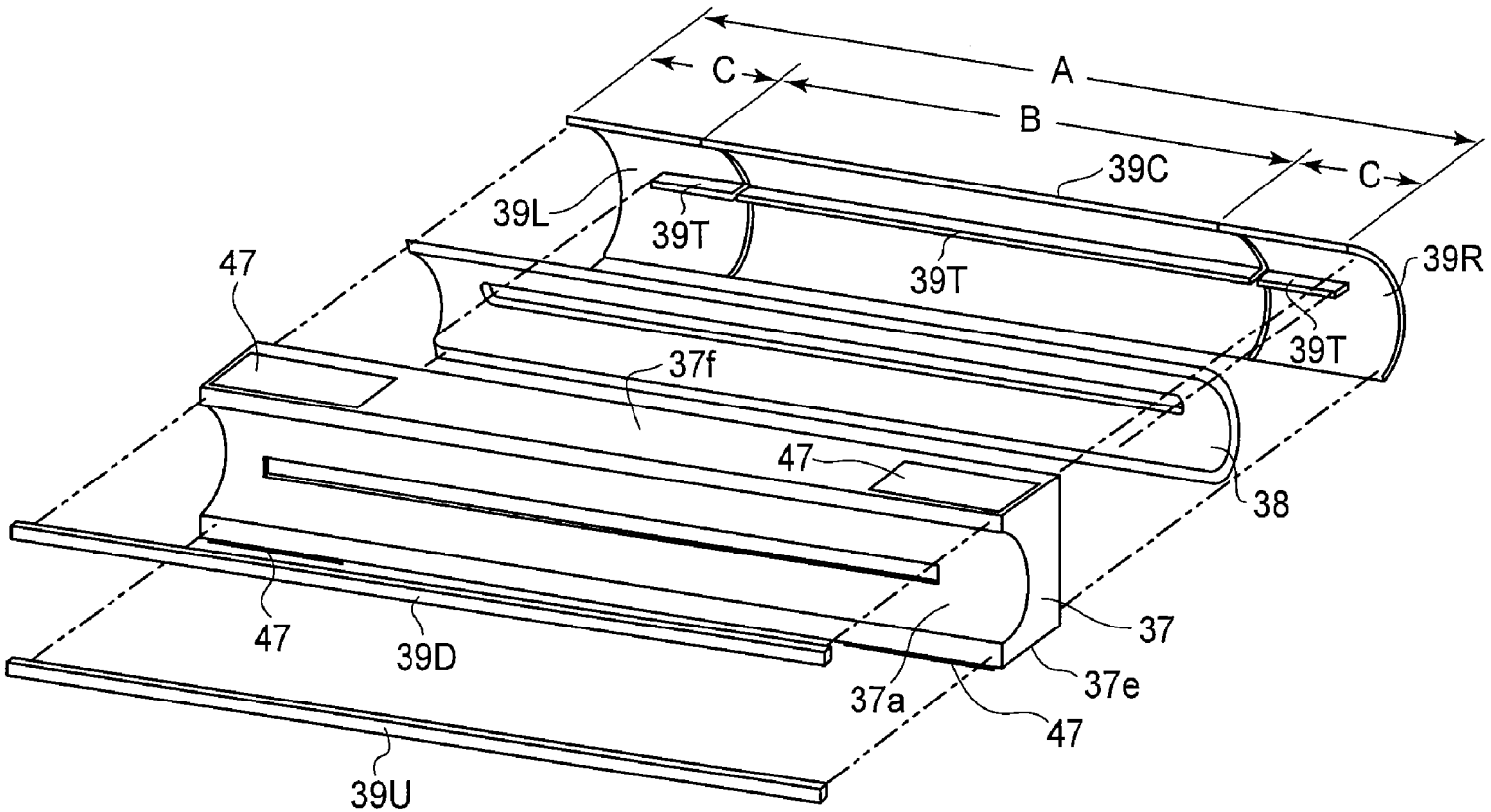
FIG. 8 is an exploded view of the exciter coil assembly, and shows the housing, the exciter coil, and the magnetic core, of the assembly.

Next, the structure of the exciter coil assembly 33 will be described. FIG. 6 is a perspective view of the fixation roller 31, the pressure roller 32, and the exciter coil assembly 33, as seen from the recording medium sheet entrance side. FIG. 7 is a plan view of the exciter coil assembly 33, as seen from the opposite side from fixation roller 31. FIG. 8 is an exploded perspective view of the housing 37, exciter coil 38, and the magnetic core assembly 39 (39C, 39L, 39R, 39T, 39U, and 39D) of the exciter coil assembly 33.

The housing 37 is in the form of a rectangular parallelepiped, the left-and-right direction of which coincides with its lengthwise direction. It is molded of a heat resistant resin. The bottom plate 37*a* side of the housing 37 faces the fixation roller 31. Referring to FIG. 8, the bottom plate 37*a* of the housing 37 is curved inward of the housing 37 so that it covers roughly half of the peripheral surface of the fixation roller 31, with the presence of a uniform gap between itself and the peripheral surface of the fixation roller 31. The housing 37 has an opening 37*b*, which is on the opposite side from the bottom plate 37*a*. The housing 37 is solidly attached to the left and right lateral plates 34L and 34R of the main assembly frame 34; its left and right end portions are attached to the lateral plates 34L and 34R, respectively, with the use of screws as solidly attaching means.

The exciter coil 38 is roughly in the form of an ellipse (shape of long and narrow boat), the lengthwise direction of which corresponds to the lengthwise direction of the fixation roller 31. It is disposed in the housing 37 in such a manner that its inward contour follows the peripheral surface of the fixation roller 31, and its outward contour follows the inward surface of the inward curved bottom plate 37*a* of the housing 37. As the wire for the exciter coil 38, a Litz wire made by bundling roughly 80-160 pieces fine wires, which are 0.1-0.3 mm in diameter, is used. As the fine wires, electric wires covered with an insulative substance are used. Further, the coil is formed by winding the Litz wire 8-2 times around the magnetic cores 39C, 39L, 39R, 39T, 39U, and 39D.

Next, referring to FIG. 8, the positioning of each of the magnetic cores 39 will be described. The magnetic core assembly 39 is separated in the direction perpendicular to the recording medium conveyance direction. Further, at least one of the multiple magnetic cores is movable by a moving means between a first position which corresponds to a preset point of the exciter coil 38, and a second position which is a preset amount of distance away from the first position. Further, there are electrically conductive members, which are outside the housing 37 (magnetic flux generating unit) and correspond in position to the movable magnetic core(s).

In this embodiment, the first magnetic core assembly 39 is made up of a central or center core 39C, a left end core 39L, a right end core 39R, a coil center core 39T, an upstream core 39U, and a downstream core 39D. The coil center core 39T is in the center of the exciter coil 38. The central core 39C, the left end core 39L, and the right end core 39R are in the housing 37 in which the exciter coil 38 is stored, and are in alignment with each other in the lengthwise direction of the housing 37. The magnetic flux generating unit is structured so that these cores 39C, 39L, 39R, and 39T surround the center and adjacencies of the exciter coil 38. The portion of the coil center core 39T, which corresponds in position to the central core 39C, is integral with the central core 39C, whereas the portion of the coil center core 39T, which corresponds in position to the left end core 39L, is integral with the left end core 39L, and the portion of the coil center core 39T, which corresponds in position to the right end core 39R, is integral with the right end core 39R.

The central core 39C is positioned across the small recording medium path (B), and its length is roughly the same as the width (B) of the small recording medium sheet path. The left end core 39L and right end core 39R are positioned across the left and right areas C ((A−B)/2) between the left edge of the large recording medium sheet path and the left edge of the small recording medium sheet path, and between the right edge of the large recording medium sheet path and the right edge of the small recording medium sheet path. The length of the left end core 39L and right end core 39R is the same as the width of the range C. The total of the length of the central core 39C, the length of the left end core 39L, and the length of the right end core 39R, is roughly the same as the width of the large size recording medium sheet path A. The central core 39C is immovably attached to the housing 37 in such a manner that it opposes the exciter coil 38 in a preset manner.

Figure 9:
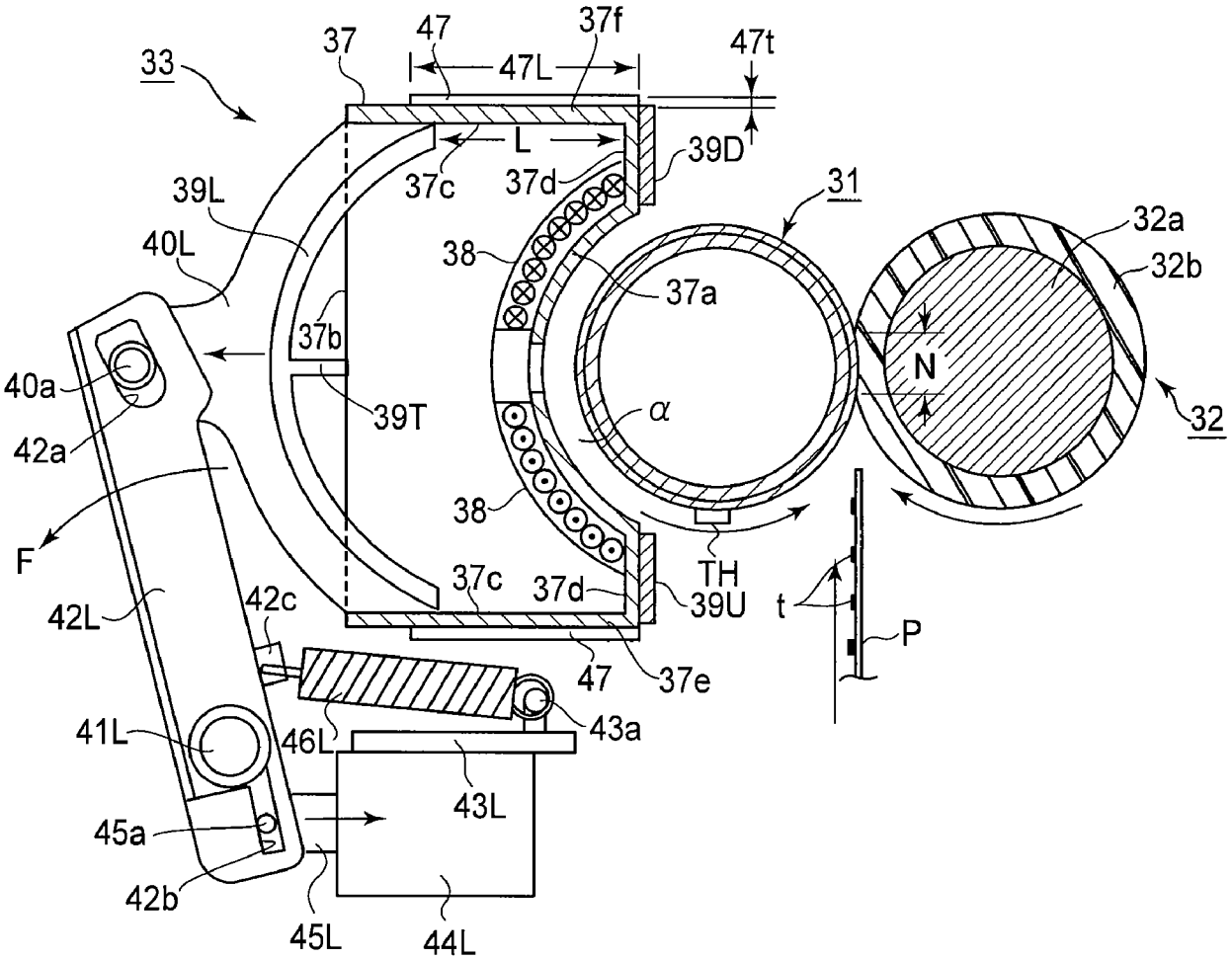

Further, the left end core 39L and the right end core 39R are movable by a core moving mechanism (moving means, which will be described later) so that they can be placed in the first or second position. Referring to FIG. 8, in this embodiment, the first position of the left end core 39L, and the first position of the right end core 39R, are such positions that the left end core 39L and the right end core 39R oppose the exciter coil 38 in a preset manner as does the central core 39C. Referring to FIG. 9, the second position of the left end core 39L, and the second position of the right end core 39R, are such positions that when the left end core 39L and the right end core 39R are in their second position, there is a greater distance between the exciter coil 38 and the left end core 39L, and between the exciter coil 38 and the right end core 39R.

The upstream core 39U and downstream core 39D are on the outward side of the bottom plate 37*a* of the housing 37, and are on the upstream and downstream sides, respectively, of the curved portion of the bottom plate 37*a*, in terms of the recording medium conveyance direction. They are immovably attached to the housing 37 in such a manner that their lengthwise direction matches the lengthwise direction of the housing 37. The upstream core 39U and the downstream core 39D are positioned so that their position matches the position of the large recording medium sheet path A. Their length is roughly the same as the width of the large medium sheet path A.

The magnetic core assembly 39 (39C, 39L, 39R, 39T, 39U, and 29D) plays the role of efficiently guiding the alternating magnetic flux generated by the exciter coil 38, to the fixation roller 31 which is an inductive heat generating member. That is, the magnetic core assembly 39 is used for increasing the magnetic circuit in efficiency, and blocking the magnetism. As the material for the magnetic core assembly 39, it is recommendable to use a substance, such as ferrite, which is high in magnetic permeability, and low in residual magnetic flux density.

The left end core 39L and the right end core 39R have core holders 40L and 40R, respectively, which are made of a resin, and are thermally welded to the left end core 39L and right end core 39R, respectively. Each of the core holders 40L and 40R is movable in the housing 37, toward the bottom plate 37*a*, or away from the bottom plate 37*a*, that is, toward the opening 37*b*, while being guided by the inward surface of each of the lateral walls 37*c* of the housing 37.

The main assembly frame 34 is provided with a pair of shafts 41L and 41R, which are immovably attached to the inward surface of the left lateral wall 34L of the main assembly frame 34 and the inward surface of the right lateral wall 34R of the main assembly frame 34, respectively. The shafts 41L and 41R are fitted with levers 42L and 42R, which are rotatable about the shafts 41L and 41R, respectively. The left lever 42L and the left core holder 40L are in connection with each other. More concretely, one end of the left lever 42L is provided with a hole 42*a*, which is elongated in cross section, and the left core holder 40L is provided with a shaft 40*a* (pin), which is fitted in the hole 42*a* of the left lever 42L. Similarly, the right lever 42R and the right core holder 40R are in connection with each other. More concretely, one end of the right lever 42R is provided with a hole 42*a*, which is elongated in cross section, and the right core holder 40R is provided with a shaft 40*a* (pin), which is fitted in the hole 42*a* of the lever 42R.

Further, the left and right lateral plates 34L and 34R of the main assembly frame 34 are provided with supporting plates 43L and 43R, which are immovably attached to the inward surface of the lateral plates 34L and 34R, respectively. There are solenoid switches 44L and 44R on the supporting plates 43L and 43R, being immovably attached to the supporting plates 43L and 43R, respectively. The plunger 45L of the left solenoid switch 44L is provided with a small shaft 45*a*, and the opposite end of the left lever 42L from the hole 42*a* is provided with a hole 42*b*, which is elongated in cross section. The small shaft 45*a* is fitted in the hole 42*b*. That is, the left solenoid switch 44L is in connection with the left lever 42L. Further, the plunger 45R of the right solenoid switch 44R is provided with a small shaft 45*a*, and the opposite end of the right lever 42R from the hole 42*a* is provided with a hole 42*b*, which is elongated in cross section. The small shaft 45*a* is fitted in the hole 42*b*. That is, the right solenoid switch 44R is in connection with the right lever 42R.

One of the end portions of the left lever 42L is provided with a spring hanger 42*c*, and the left supporting plate 43L is provided with a spring hanger 43*a*. Further, there is a tension spring 46L stretched between the spring hangers 42*c* and 43*a*. Thus, the left lever 42L is kept pulled by the pulling force from the tension spring 46L, in the direction to rotate the left lever 42L about the shaft 41L to move the left core holder 40L toward the bottom plate 37*a* of the housing 37. Similarly, one of the end portions of the right lever 42R is provided with a spring hanger 42*c*, and the right supporting plate 43L is provided with a spring hanger 43*a*. Further, there is a tension spring 46R stretched between the spring hangers 42*c* and 43*a*. Thus, the right lever 42R is kept pulled by the pulling force from the tension spring 46R, in the direction to rotate the right lever 42R about the shaft 41R to move the right core holder 40R toward the bottom plate 37*a* of the housing 37.

While the electric power to the left and right solenoid switches 44L and 44R is off, there is no force which pulls the plungers 45L and 45R inward of the solenoids switches 44L and 44R. Therefore, the left and right levers 42L and 42R are sufficiently rotated by the pulling force from the tension springs 46L and 46R, about the shafts 41L and 41R, to make the core holders 40L and 40R to move toward the bottom plate 37*a* of the housing 37, that is, in the direction indicated by an arrow mark E, as shown in FIG. 3. Thus, the left and right end cores 39L and 39R come into contact with the end core positioning portions 37*d* (which are parts of inward surface of bottom plate 37*a*), being thereby precisely positioned. When the left and right cores 39L and 39R are in contact with the end core positioning portions 37*d*, the left and right end cores 39L and 39R are in their first positions (home positions).

On the other hand, as the electric power to the left and right solenoid switches 44L and 44R is turned on, the plungers 45L and 45R are pulled into the solenoids of the solenoid switches 44L and 44R as shown in FIG. 9. Thus, the left and right levers 42L and 42R are sufficiently rotated about the shafts 41L and 41R in the direction indicated by reference character F while stretching the springs 46L and 46R against their tension. This direction F is the direction in which the core holders 40L and 40R are moved from the bottom plate 37*a* of the housing 37 toward the opening 37*b* of the housing 37. Therefore, the left and right end cores 39L and 39R move from the abovementioned first position to their second position, which is a preset distance away from their first position. Thus, the gap between the left end core 39L and exciter coil 38, and the gap between the right end core 39R and exciter coil 38, become wider. In this embodiment, the levers 42L and 42R are used as the parts of the core moving mechanism, and therefore, it is possible to make longer the moving distance of the core holders 40L and 40R, and the end cores 39L and 39R, than that of a conventional fixing apparatus.

Further, the fixing apparatus 20 is provided with four electrically conductive members 47. More concretely, in terms of the recording medium conveyance direction, two of the electrically conductive members 47 are on the left and right end portions of the outward surface of the upstream lateral plate 37*e* of the housing 37, and on the opposite side of the lateral plate 37*e* from the left and right end cores 39L and 39R, respectively, which are movable, whereas the other two are on the left and right end portions of the outward surface of the downstream lateral plate 37*f* of the housing 37, and on the opposite side from the lateral plate 37*f* from the left and right end cores 39L and 39R, one for one. Referring to FIG. 9, each of the electrically conductive members 47 is positioned so that when the left and right end cores 39L and 39R are in their second position, it opposes the space created in the housing 37 by the movement of the left and right end cores 39L and 39R into their second position. Further, in terms of the direction parallel to the rotational axis of the fixation roller 31, each electrically conductive member 47 is positioned so that it opposes the corresponding magnetic core, which is movable in the direction parallel to the rotational axis of the fixation roller 31. Each of the electrically conductive members 47 is a magnetic flux adjusting member, which reduces, in magnetic flux density, the space created by the movement of the left and right end cores 39L and 39R. Each of the electrically conductive members 47 is a piece of thin plate made of a metallic substance, for example, which is low in magnetic permeability. It is attached to the abovementioned outward surface of the housing 37 with the use of adhesive.

Figure 10:
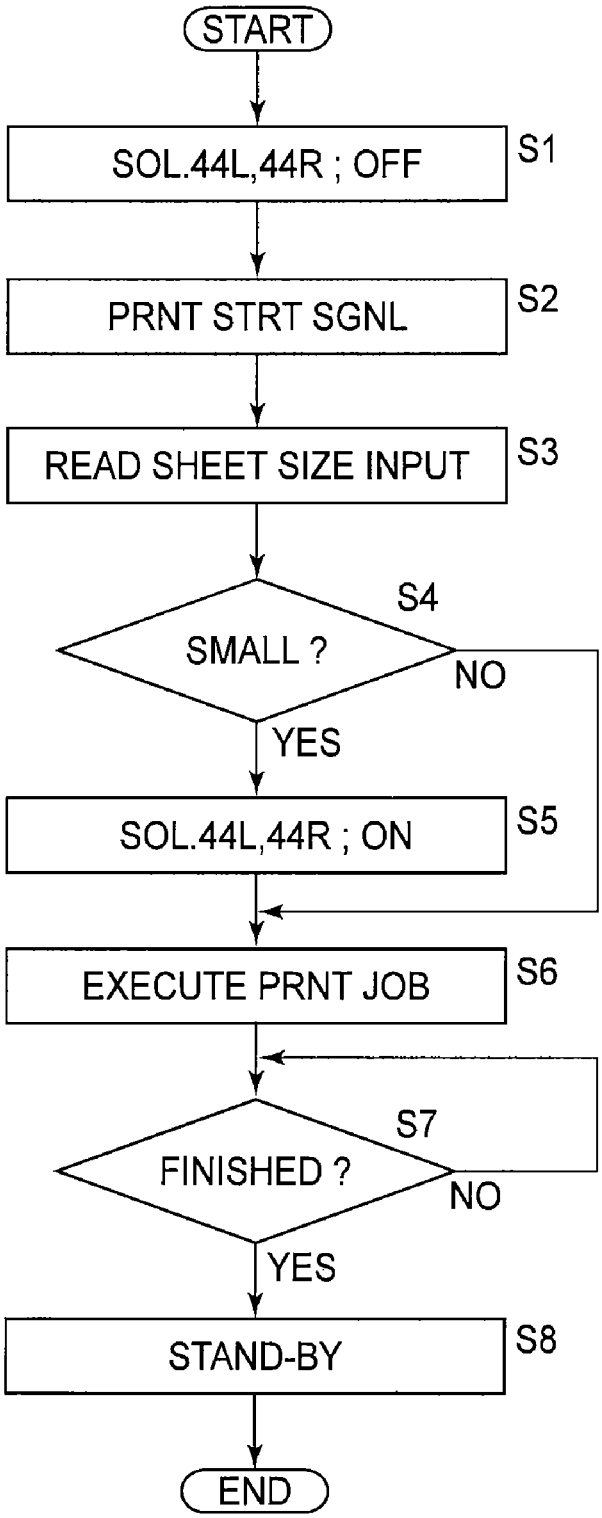
FIG. 10 is a flowchart for the control of the core moving mechanism.

FIG. 10 is a flowchart of the operation of the core moving mechanism which includes the solenoids switches 44L and 44R as described above. While the image forming apparatus is kept on standby, the control circuit 100 keeps turned off the electric power to the left and right solenoids 44L and 44R (Step 1). Thus, the left and right end cores 39L and 39R are kept in their first position, which is close to (preset distance) the exciter coil 38, as is the center core 39C, as shown in FIG. 3. As a print start signal is inputted (Step 2), the control circuit 100 reads the recording medium size value inputted from the external host apparatus 200, or the recording medium size inputting means of the control panel 300 (Step 3). Then, the control circuit 100 determines whether the inputted value belongs to the large size recording medium sheet or the small size recording medium sheet (Step 4). If it determines that the value belongs to the small size recording medium sheet, it turns on the electric power to the left and right solenoid switches 44L and 44R (Step 5). Thus, the left and right end cores 39L and 39R are moved to their second position, as shown in FIG. 9. Then, the control circuit 100 makes the image forming apparatus carry out a printing job which outputs a preset number of copies, using the small size recording medium sheets (Step 6). After the completion of the job (Step 7), the control circuit 100 puts the image forming apparatus on standby, and waits for the inputting of the printing start signal for the next printing job (Step 8).

On the other hand, if the control circuit 100 determines in Step 4 that the value belongs to the large size recording medium sheet, it keeps turned on the electric power to the left and right solenoid switches 44L and 44R, and makes the image forming apparatus carry out a printing job which outputs a preset number of copies, using the large size recording medium sheets (Step 6). After the completion of the job (Step 7), the control circuit 100 puts the image forming apparatus on standby, and waits for the inputting of the printing start signal for the next printing job (Step 8).

Figure 11:
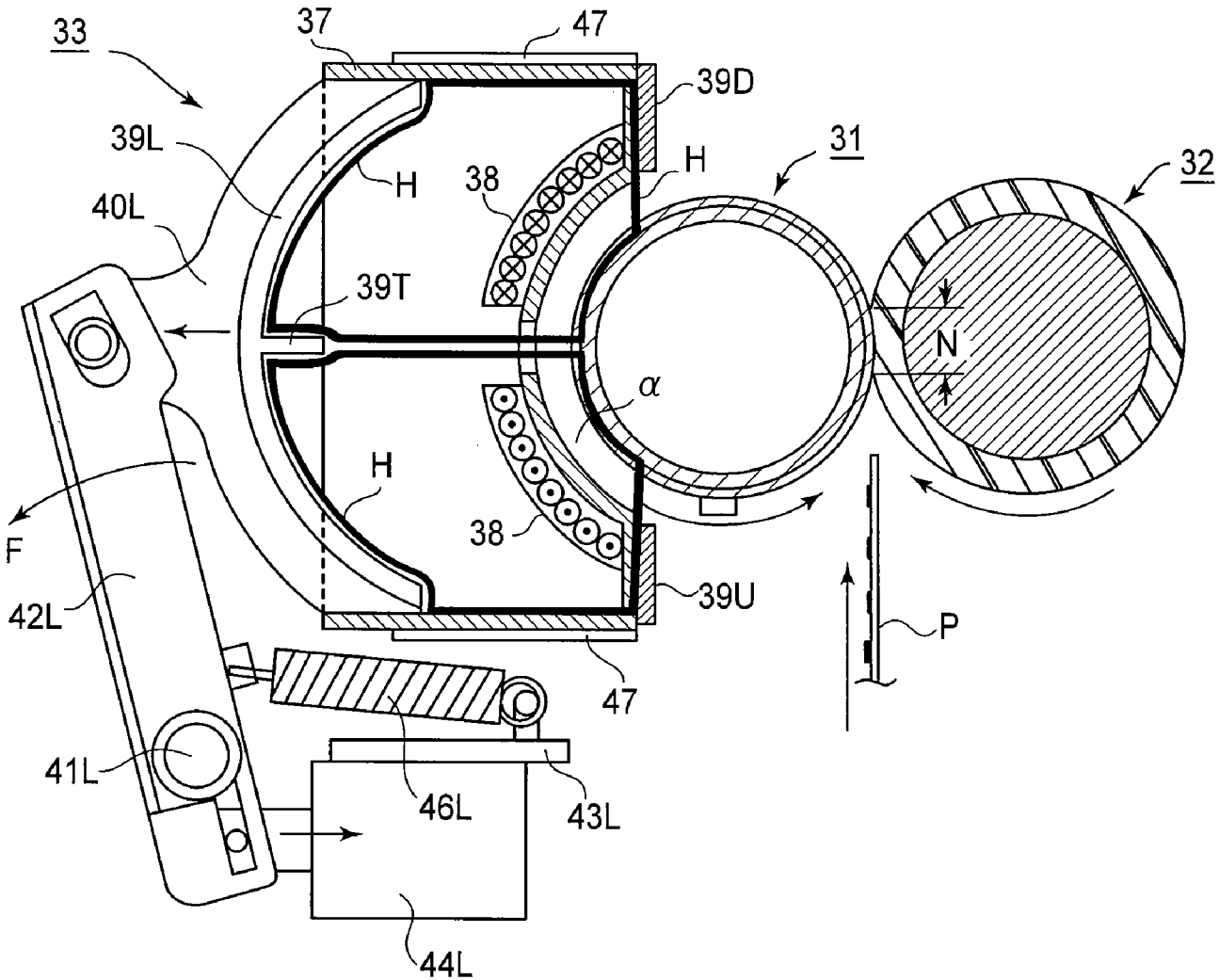
FIG. 11 is a drawing of the magnetic circuit of the fixing apparatus when the fixing apparatus is in the state shown in FIG. 9.

As described above, in the case where the recording medium sheet to be used is the small size recording medium sheet, the left and right end cores 39L and 39R are moved to their second position as shown in FIG. 9. Thus, the gap between the left end core 39L and exciter coil 38, and the gap between the right end core 39R and exciter coil 38, become wider. It is in this condition that the pressure roller 32 of the fixing apparatus 20 is driven, and electric power is sent to the exciter coil 38 to carrying out a fixing operation. Shown in a bold line in FIG. 11 is the magnetic circuit made up of the left and right end cores 39L and 39R, and the fixation roller 31 (which is inductive heat generating member), around the exciter coil 38.

Figure 12:
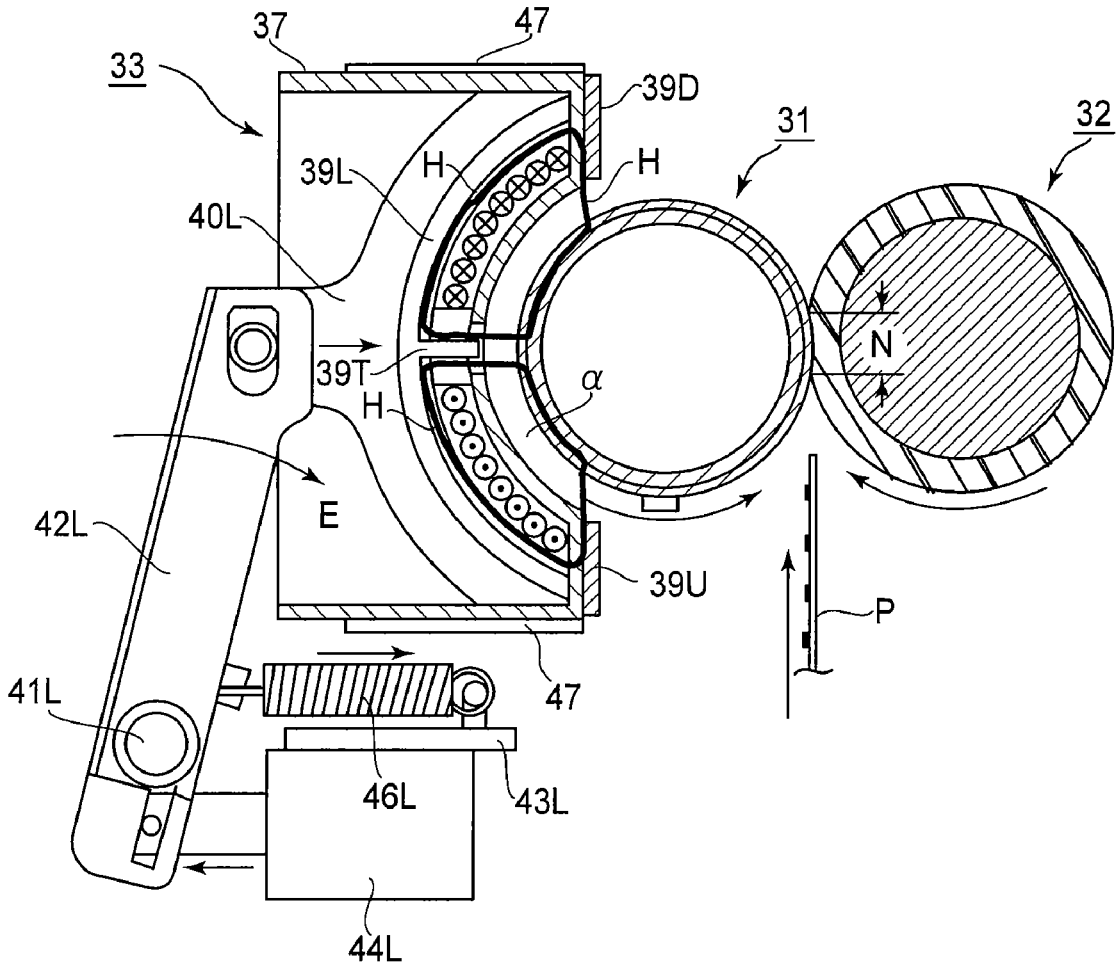
FIG. 12 is a drawing of the magnetic circuit of the fixing apparatus when the fixing apparatus is in the state shown in FIG. 3.

Referring to FIG. 3, in the case where the recording medium sheet used for image formation is the large size recording medium sheet, the left and right end core 39L and 39R are left in, or moved back into, their first position. While the fixing apparatus 20 is in this condition, its pressure roller 32 is driven, and the exciter coil 38 is provided with electric power, to carry out a fixing operation. Shown in a bold line in FIG. 12 is the magnetic circuit made up of the left and right end cores 39L and 39R, and fixation roller 31 (which is inductive heat generating member), around the exciter coil 38.

In the case where the recording medium sheet to be used is the small size recording medium sheet, the gap between the left end core 39L and exciter coil 38, and the gap between the right end core 39R and exciter coil 38, are wider. Therefore, the magnetic circuit generated around the exciter coil 38 by the left and right end cores 39L and 39R, and the fixation roller 31 (which is inductive heat generating member), are lower in efficiency. Thus, the portions of the fixation roller 31, which correspond to the areas C ((A−B)/2), which are between the left edge of the large recording medium sheet path A and the left edge of the small recording medium sheet path B, and between the right edge of the large recording medium sheet path A and the right edge of the small recording medium sheet path B, reduce the amount of heat they generate (effect A).

Further, each of the electrically conductive members 47 is held by the housing 37 in such a position that it opposes the space which is created as the left and right core 39L and 39R are moved to their second position. Not only do the electrically conductive members 47 play the role of preventing the magnetic flux from leaking out of the fixing apparatus 20, but also, they play the following role.

That is, each of the electrically conductive members 47 partially intersects the magnetic flux H generated by the exciter coil 38, and therefore, electric current is electromagnetically induced in the electrically conductive member 37, affecting thereby the magnetic flux H (FIG. 11) from the exciter coil 38. That is, if the electrically conductive member 47 is positioned so that it intersects the magnetic flux H of the exciter coil 38, electric power is generated in the electrically conductive member 47 by an amount proportional to the ratio by which the magnetic flux H is affected by the electrically conductive member 47, because of the law of electric magnetic induction. Thus, a closed circuit (linkage circuit), through which the electromagnetically induced current flows, is formed in the electrically conductive member 47. The direction in which the electric power generating force is generated, or the direction in which the electric current flows by the generated electric power generating force, is such a direction that the magnetic flux generated by the generated electric current interferes with the changes in the intersected portion of the magnetic flux.

Therefore, in the area of the magnetic flux that intersects the electrically conductive member 47, that is, in the area C, the magnetic flux decreases in density, and therefore, the amount of heat generated in the portion of the fixation roller 31 that corresponds to the area C, decreases (effect B).

As described above, in the case where the small size recording medium sheet is conveyed through the fixing apparatus 20, the abovementioned effects A and B are created. Therefore, the amount of heat generated in the portions of the fixation roller 31, which do not correspond to the small recording medium sheet path B, is significantly smaller than the amount of heat generated by the counterparts in an image forming apparatus in accordance with any of the conventional technologies.

Further, the fixing apparatus 20 is structured so that none of the electrically conductive members 47 is moved, and only the left and right end cores 39L and 39R are moved. Therefore, the apparatus is not overly complicated, and also, relatively small.

Further, in order to reduce the amount of electric power consumption while preventing the electrically conductive member 47 from increasing in temperature due to the heat generating in themselves, the electrically conductive members 47 are made of an electrically conductive substance which is low in magnetic permeability. The specific magnetic permeability of the electrically conductive members 47 is no less than 0.9 and no more than 1.1. As the material for the electrically conductive members 47, copper, aluminum, silver, and lead, for example, can be listed. As for the specific magnetic permeability of the abovementioned substances, copper is 0.999991; aluminum, 1.00002; silver, 0.99998; and lead is 0.999983. Further, from the standpoint of reducing the amount of heat generated by the electrically conductive members 47, a metallic plate which is low in electrical resistance is preferable as the material for the electrically conductive members 47.

According to the principle of heat generation by electromagnetic induction, as electric current flows through a member which intrsects a magnetic flux, heat is generated in the member by electric power, the amount of which is proportional to the amount of the skin resistance Rs of the member. Here, when the angular frequency is denoted by ω; the magnetic permeability is denoted by μ; and the specific resistance is denoted by ρ, the skin depth δ is expressed in the form of the following equation.

$$\delta=(2\rho/\mu\omega)/2$$

Further, the skin resistance Rs is expressed in the form of the following equation.

$$Rs=\rho/\delta$$

Further, when the amount of electric current which flows in the member is I, the amount of electric power W, which is generated in the member which intersects the magnetic flux, is expressed in the form of the following equation:

$$W\propto Rs\int|I|2dS.$$

Therefore, by reducing the magnetic permeability μ, and specific resistance ρ, the electric power W can be reduced, and therefore, the amount of heat generated by the member, can be reduced.

Figure 13:
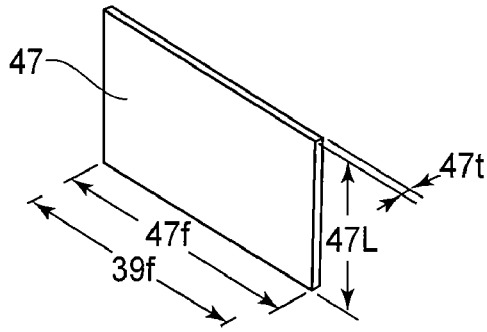
FIG. 13 is a drawing for showing the measurements of the electrically conductive member.

On the other hand, in order to prevent the magnetic flux from leaking through each of the electrically conductive members 47, the thickness 47*t* (FIGS. 9 and 13) of the electrically conductive member 47 is made greater than its skin depth δ. As described above, the skin depth δ is determined by the magnetic permeability μ of the electrically conductive member 47, the specific resistance ρ of the electrically conductive member 47, and the angular frequency ω of the magnetic flux generated by the exciter coil 38. Incidentally, in a case where the thickness 47*t* of the electrically conductive member 47 is less than the skin depth δ, the skin resistance Rs is expressed in the form of the following equation, according to the principle of electromagnetic induction:

$$Rs\approx\rho/t(t\text{:thickness})$$

In this case, therefore, the amount of heat generated by the electrically conductive member 47 increases. Further, from the standpoint of making the electrically conductive member 47 exhibit its magnetic flux reducing effect as much as possible, it is effective to dispose the electrically conductive member 47 in the areas where the magnetic flux from the exciter coil 38 is not widespread. That is, it is recommendable that the electrically conductive members 47 are disposed so that they are close to the exciter coil 38, form a magnetic circuit with the left and right end cores 39L and 39R, the upstream and downstream cores 39U and 39D, and the fixation roller (inductive heating member), and allow the magnetic flux to leak outward as little as possible. In this embodiment, the electrically conductive members 47 are in the adjacencies of the paths of the end cores 39L and 39R. In reality, they are immovably and directly attached to the housing 37 which has the guiding means 37*c* for the core holders 40L and 40R, as shown in FIG. 9. The fixing apparatus 20 is structured so that the length 47*f* of the electrically conductive member 47 (FIGS. 9 and 13) in terms of the moving direction of the end cores 39L and 39R is made longer than the distance L (FIG. 9) which the end cores 39L and 39R move. Thus, even if the gap, which forms between the magnetic core 39 and exciter coil 38 as the magnetic core 39 is moved, widens, the presence of the electrically conductive members 47 minimizes the amount of magnetic flux leak, and therefore, minimizes the effects of the magnetic flux upon the components which are in the adjacencies of the apparatus.

For the purpose of maximumly utilizing the effects of the reduction in the amount of the magnetic flux by the electrically conductive members 47, the length 47*f* (FIG. 13) of each of the electrically conductive members 47 in terms of the direction parallel to the rotational axis of the fixation roller 31 is made longer than the length 39*f* of the end cores 39L and 39R in terms of the same direction. Incidentally, the length 47*f* of each of the electrically conductive members 47 has only to be such that each of the electrically conductive members 47 fits in the space created by the movement of the left and right end cores 39L and 39R. Thus, the fixing apparatus 20 may be structured so that the electrically conductive members 47 cover the external surface of the end cores 39L and 39R, or the external surface of all of the magnetic cores 39C, 39L, 39R, 39T, 39U, and 39D.

Referring to FIG. 3, in the case where the large size recording medium sheet is used as the recording medium, the left and right end cores 39L and 39R are moved to their first position, and kept there. It is in this condition that the fixing apparatus 20 is activated for fixation; the pressure roller 32 is driven, and electric power flows through the exciter coil 38. Thus, the fixation roller 31 is uniformly heated across its portion corresponding to the range A which corresponds to the path of the large size recording medium sheet.

Incidentally, the fixing apparatus 20 in this embodiment may be structured so that the end cores 39L and 39R are directly connected to the levers 42L and 42R of the core moving mechanism to eliminate the core holders 40L and 40R.

Embodiment 2

This embodiment of the present invention shows another structural example for the core moving mechanism (core moving means) of the fixing apparatus 20. The structural members, portions, etc., of the fixing apparatus in this embodiment, which are the same as those of the fixing apparatus 20 in the first embodiment, are given the same reference numerals and characters as those given to the counterparts of the fixing apparatus 20 in the first embodiment, and will not be described here.

Figure 14:
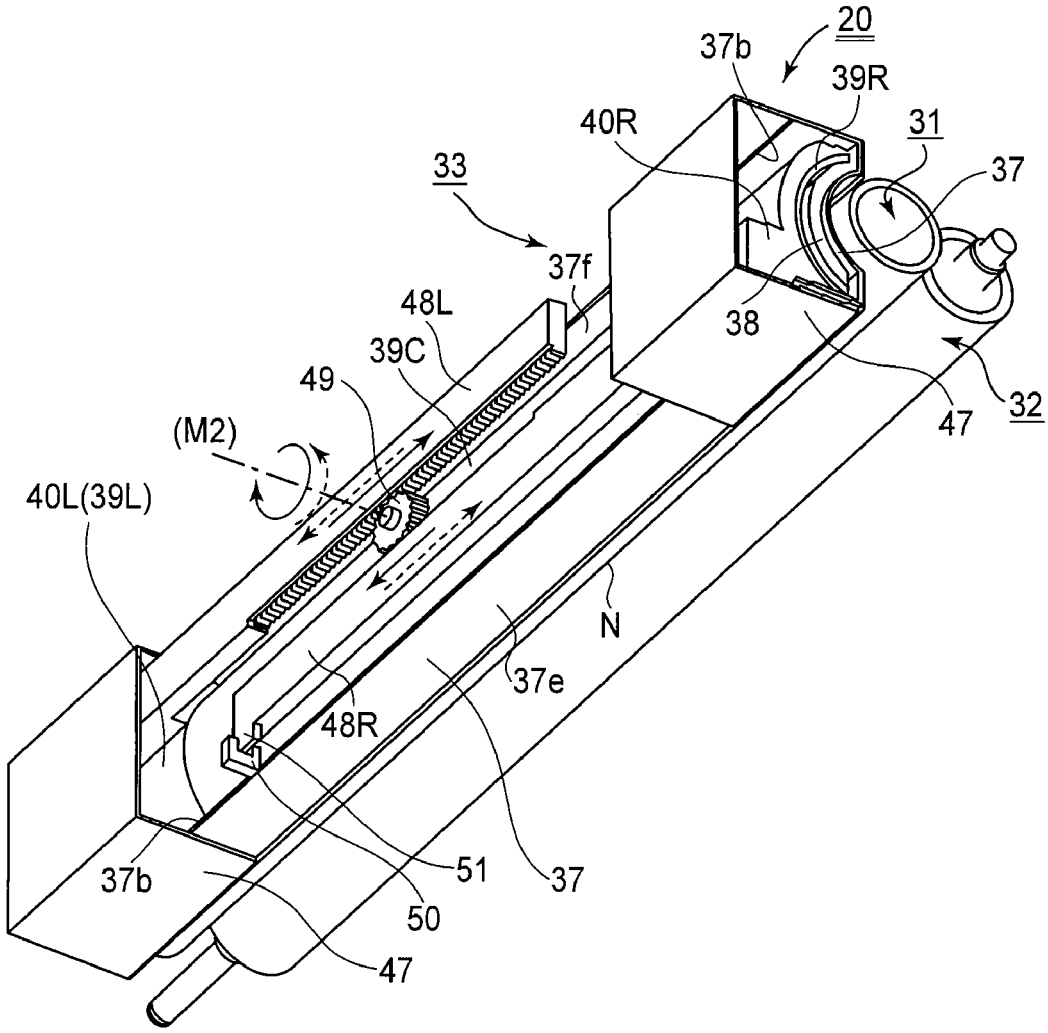
FIG. 14 is a perspective view of the fixation roller, the pressure roller, and the exciter coil assembly of the fixing apparatus in the second preferred embodiment of the present invention, as seen from the recording medium entrance side of the fixing apparatus.
Figure 15:
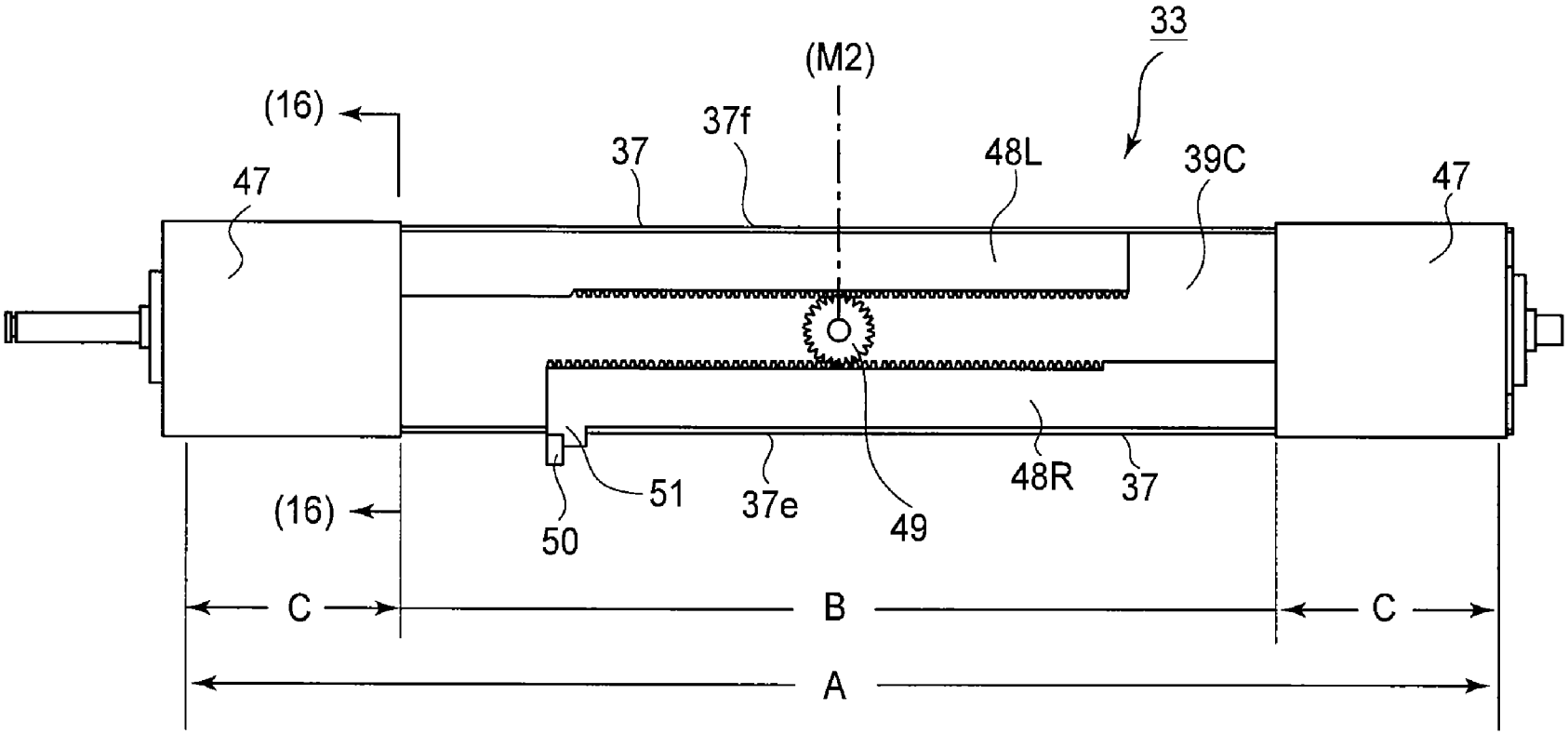
FIG. 15 is a plan view of the exciter coil assembly as seen from the opposite side from the fixation roller.
Figure 16:
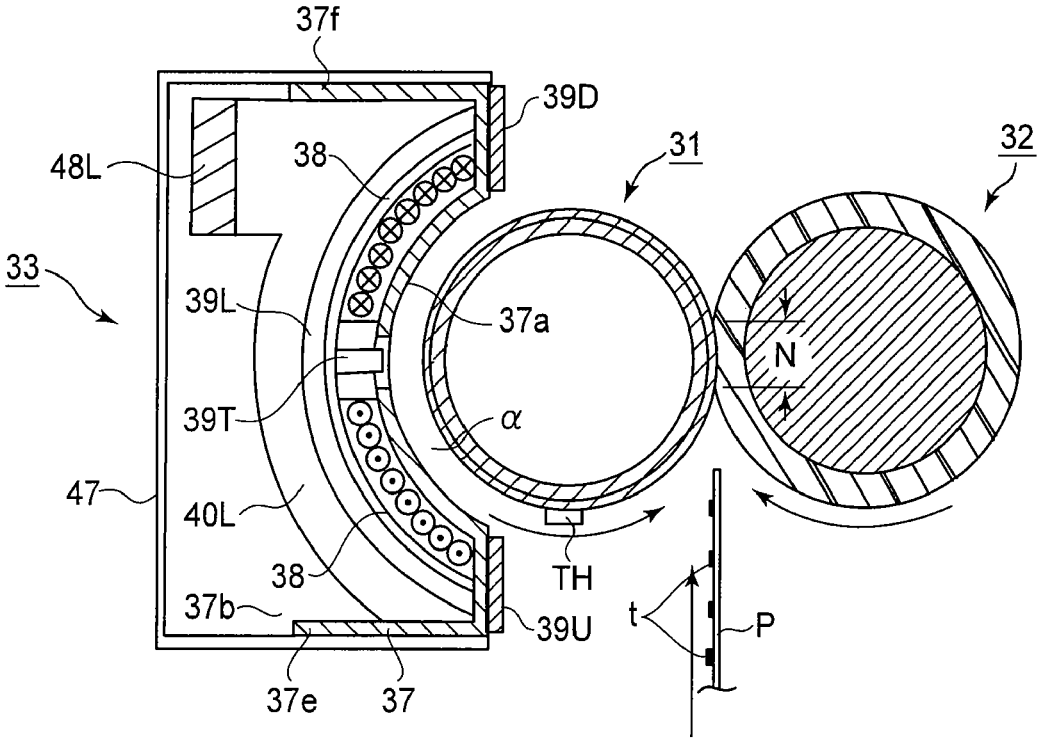
FIG. 16 is an enlarged schematic cross-sectional view of the left end portion of the fixing apparatus in FIG. 15, at a plane (16)-(16) in FIG. 15.

FIG. 14 is a perspective view of the fixation roller 31, the pressure roller 32, and the exciter coil assembly 33, as seen from the recording medium entrance side of the fixing apparatus 20. FIG. 15 is a plan view of the exciter coil assembly 33, as seen from the opposite side from the fixation roller 31. FIG. 16 is an enlarged schematic cross-sectional view of the left end portion of the fixing apparatus in FIG. 15, at a plane (16)-(16) in FIG. 15.

The left and right end cores 39L and 39R, respectively, are held by the core holders 40L and 40R, respectively. They are thermally welded to the core holders 40L and 40R, respectively. They are in the housing 37. More specifically, the left and right end cores 39L and 39R are in their first position (home position) in which they are in the adjacencies of the exciter coil 38, with the presence of a preset amount of a gap between them and the exciter coil 38, as is the enter core 39C.

The core holders 40L and 40R are supported by the housing 37 in such a manner that they are slidably movable, relative to the housing 37, in the direction parallel to the lengthwise direction of the housing 37. Further, the core holders 40L and 40R have rack gears 48L and 48R, respectively. The rack gears 48L and 48R are long and narrow components, and are positioned in such a manner that they are parallel to each other, and oppose each other across the housing 37. Further, they are disposed in such a manner that their lengthwise direction is parallel to the lengthwise direction of the housing 37. There is disposed a pinion gear 49 between the rack gears 48L and 48R, being in meshing engagement with the rack gears 48L and 48R. The pinion gear 49 is rotatable in the forward or rearward direction by a motor M2. Thus, the left and right end cores 39L and 39R are movable in the direction parallel to the lengthwise direction of the housing 37, by the above-described core moving mechanism which is made up of the core holders 40L and 40R, the rack gears 48L and 48R, the pinion gear 49, and the motor M2, in such a manner that the left and right end cores 39L and 39R move inward or outward of the housing 37 while remaining opposite to each other in their moving direction.

The housing 37 is provided with a home position sensor 50 (which hereafter will be referred to simply as the sensor 50) for detecting whether or not the end cores are in their home position. As a sensor 50, a photo-interrupter is used. As the flag 51, with which the rack gear 48R is provided, blocks the light path of the sensor 50 by entering the light path, the sensor 50 inputs an ON-signal into the control circuit 100. Further, as the flag 51 unblocks the light path of the sensor 50 by coming out of the light path, the sensor 50 inputs an OFF-signal into the control circuit 100.

While the image forming apparatus is on standby, the control circuit 100 moves the rack gears 48L and 48R inward of the housing 37 in terms of the lengthwise direction of the housing 37 by driving the motor M2 in the "forward" direction as if the ON-signal is being inputted from the sensor 50, so that the light path of the sensor 50 remains blocked by the flag 51. Thus, the left and right end cores 39L and 39R are held in their first position where they are in the adjacencies of the end portions of the exciter coil 38, while holding the preset distance from the exciter coil 38, as is the center core 39C.

Figure 17:
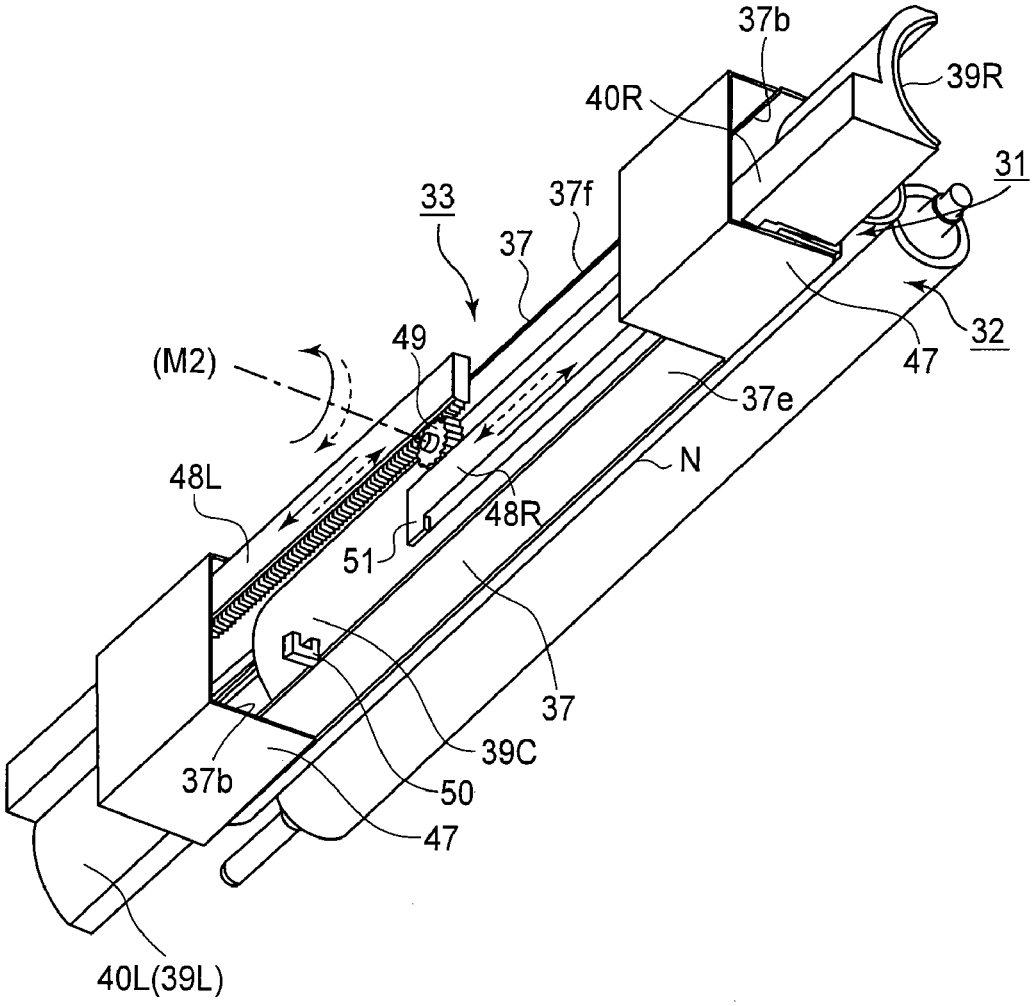
FIG. 17 is a perspective view of the fixing apparatus, in the second preferred embodiment, after the left and right end cores were moved out of the housing through the left and right end openings, respectively, of the housing.
Figure 18:
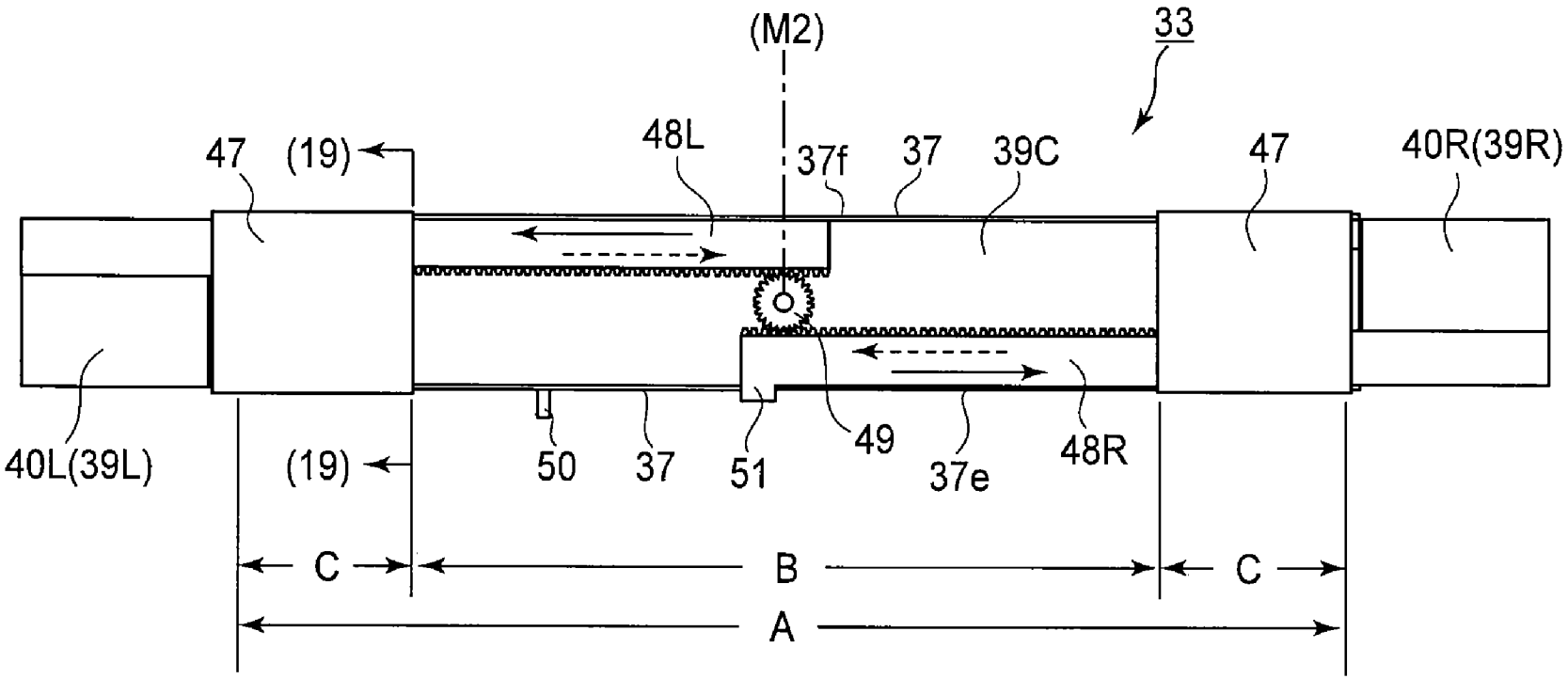
FIG. 18 is a plan view of the magnetic coil assembly, as seen from the opposite side from the fixation roller, when the magnetic coil assembly is in the state shown in FIG. 17.
Figure 19:
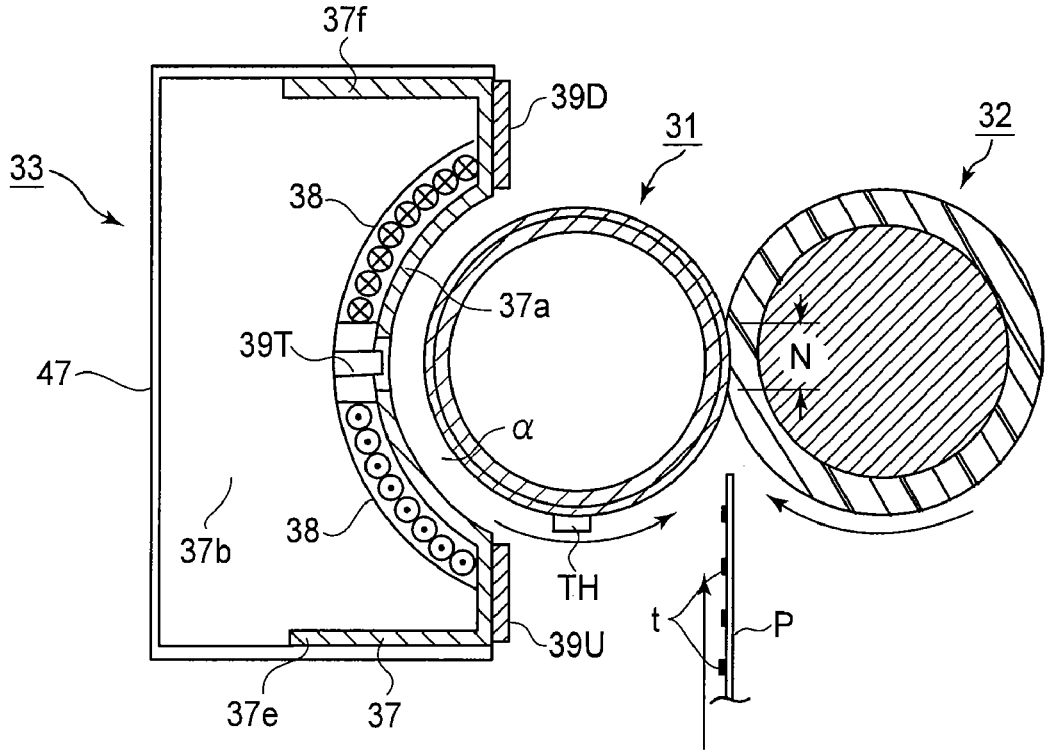
FIG. 19 is an enlarged schematic cross-sectional view of the left end portion of the fixing apparatus in FIG. 18, at a plane (19)-(19) in FIG. 18.

As the control circuit 100 receives a preset control signal while the left and right end cores 39L and 39R are held in their first position as described above, the control circuit 100 rotationally drives the motor M2 in the "reverse" direction by a preset number of revolutions (preset amount). Thus, the rack gears 48L and 48R are moved outward of the housing 37 in the lengthwise direction of the housing 37 by a preset distance. Consequently, the left and right core holders 40L and 40R, and the left and right end cores 39L and 39R on the left and right core holders 40L and 40R, respectively, are moved out of the housing 37 through the left and right openings of the housing 37 as shown in FIGS. 17 and 18. That is, the left and right end cores 39L and 39R are retracted, in the lengthwise direction of the housing 37, out of their position in the housing 37, in which they oppose the exciter coil 38, into their second position where they are farther away from the exciter coil 38 than when they are in their first position. FIG. 17 is a perspective view of the fixation roller 31, pressure roller 32, magnetic coil assembly 33, left and right end cores 39L and 39R, and housing 37, while the left and right end cores 39L and 39R in their outside position (second position) into which they were moved through the left and right end openings of the housing 37, respectively. FIG. 18 is a plan view of the magnetic coil assembly 33, as seen from the opposite side from the fixation roller 31, when the magnetic coil assembly 33 is in the state shown in FIG. 17. FIG. 19 is an enlarged schematic cross-sectional view of the left end portion of the fixing apparatus 20, at a plane (19)-(19) in FIG. 18.

In this embodiment, there is a gap between the portion of the coil center core 39T, which corresponds to the left core 39L, and the portion of the coil center core 39T, which corresponds to the right end core 39R. These portions of the coil center core 39T are immovably attached to the exciter coil 38 or housing 37, or sequential to and integral with the portion of the coil center core 39T, which corresponds in position to the center core 39C.

Further, the electrically conductive members 47 are U-shaped in cross section, and are located across the left and right end portions of the housing 37. They cover the openings 37*b* of the housing 37, and the upstream and downstream lateral plates 37*e* and 37*f* in terms of the recording medium conveyance direction. Thus, the electrically conductive members 47 correspond in position to the portions of the fixation roller 31, which correspond to the area C (the out-of-path area; area which recording medium sheet does go through).

Figure 20:
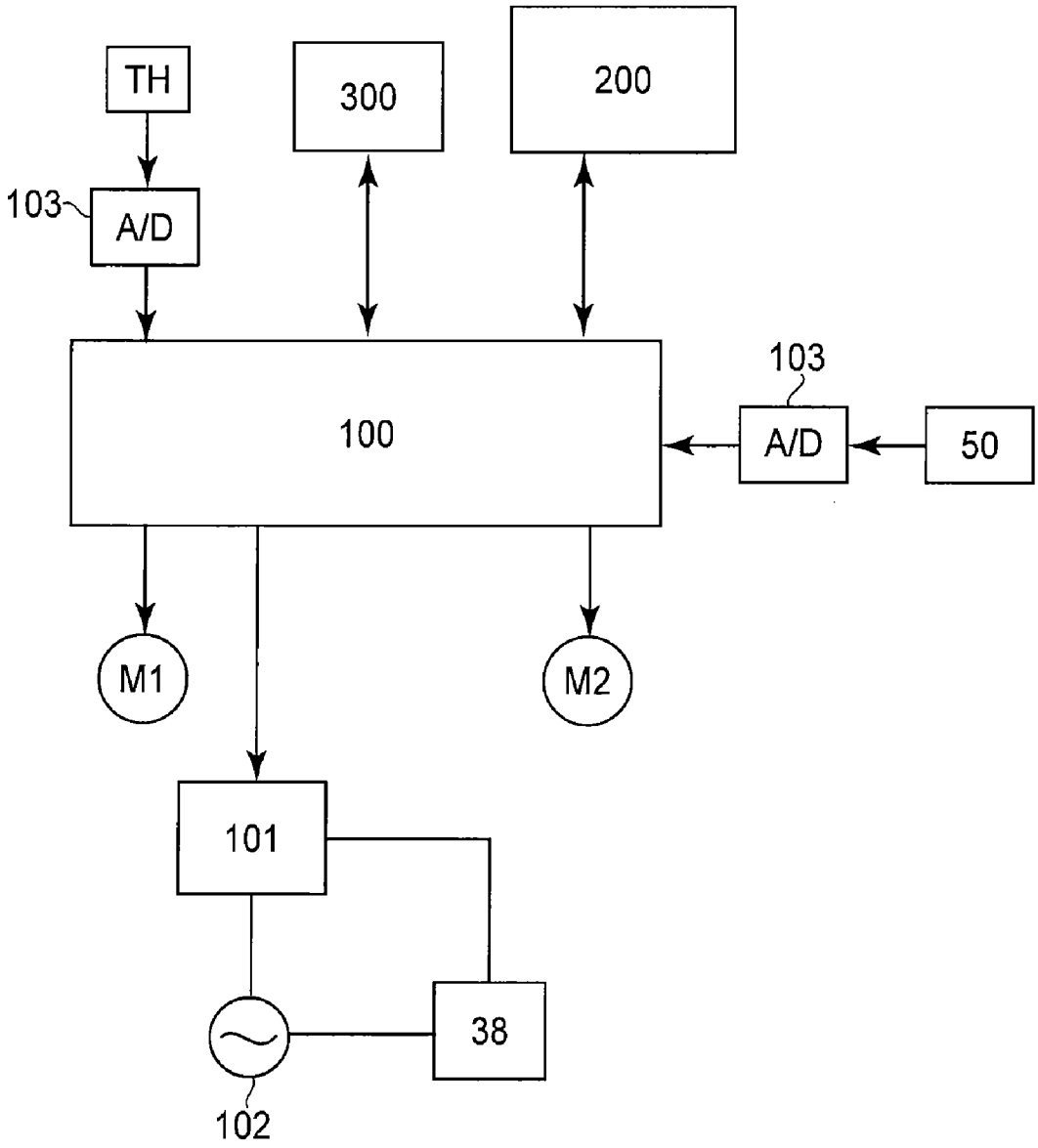
FIG. 20 is a block diagram of the control system in the second preferred embodiment.
Figure 21:
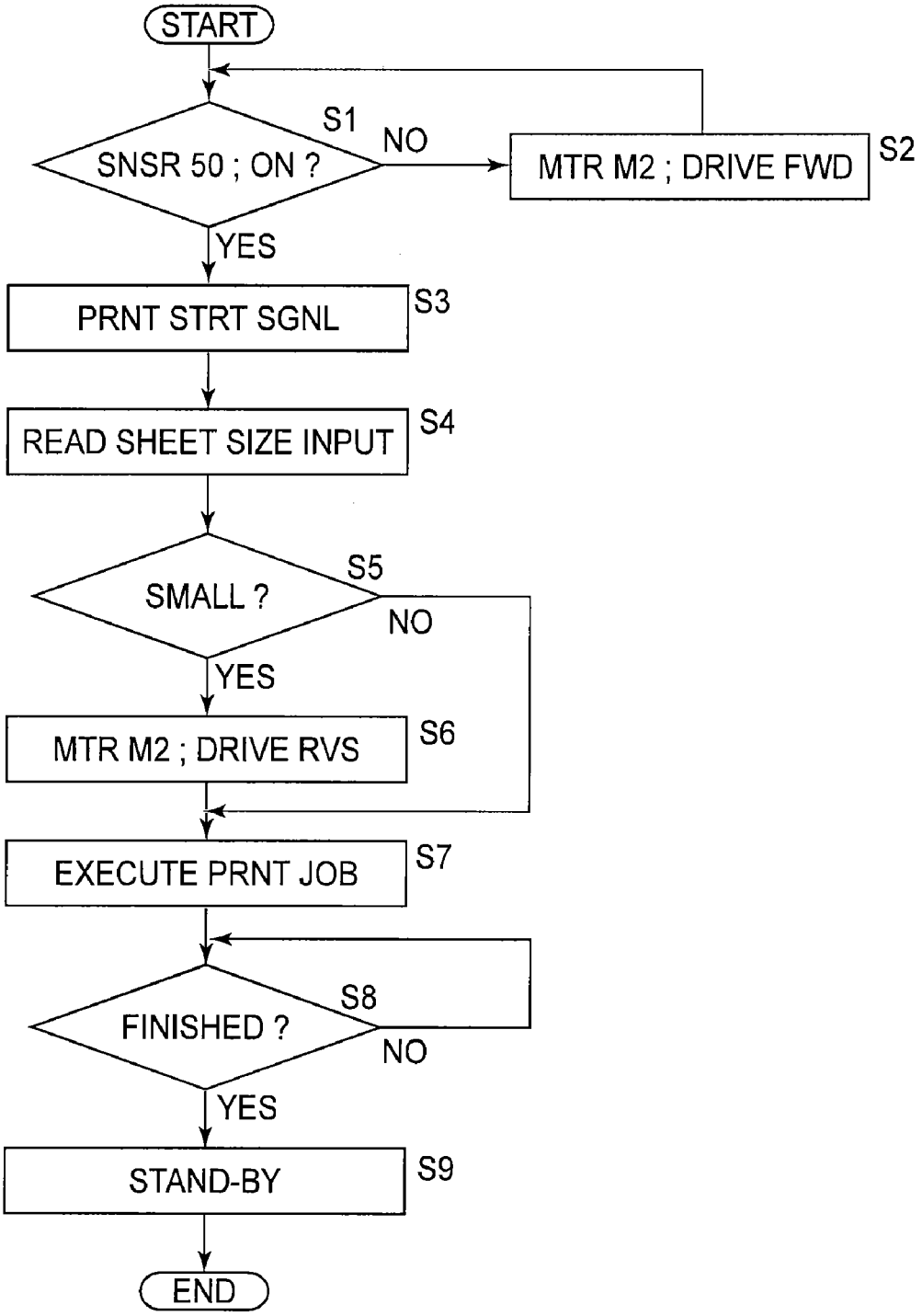
FIG. 21 is a flowchart of the control of the core moving mechanism.

FIG. 20 is a block diagram of the control system in this embodiment. FIG. 21 is a control flowchart for the core moving mechanism, in this embodiment, which includes the motor M2. When the image forming apparatus is on standby, and the input signal from the sensor 50 is off (No in Step 1), the control circuit 100 rotates the motor M2 in the "forward" direction (Step 2). Thus, the left and right rack gears 48L and 48R are moved in the lengthwise direction of the housing 37 by the "forwardly" rotating pinion gear 49. This movement of the rack gears 48L and 48R causes the flag 51 to block the light path of the sensor 50, turning on the sensor 50. As soon as the sensor 50 is turned on, the control circuit 100 stops driving the motor M2. Because of this control, the left and right end cores 39L and 39R are held in their first position as shown in FIGS. 14, 15, and 16. The signal from the sensor 50 is inputted into the control circuit 100 through an A/D convertor 103.

As a print start signal is inputted into the control circuit 100 (Step 3), the control circuit 100 reads the size (value) of the recording medium sheet to be used, which is inputted from the external host apparatus 200, or the recording medium size inputting means of the control panel 300 (Step 4). Then, the control circuit 100 determines whether the inputted value belongs to a large size recording medium sheet or a small size recording medium sheet (Step 5). If it determines that the value belongs to a small size recording medium sheet, it rotates the motor M2 in the "reverse" direction by a preset amount (preset number of rotations). Thus, the left and right rack gears 48L and 48R are moved out of the housing 37 in the lengthwise direction of the housing 37, by a preset distance. Consequently, the left and right end cores 39L and 39R are held in their second position as shown in FIGS. 17, 18, and 19. Then, the control circuit 100 makes the image forming apparatus carry out a printing job which outputs a preset number of copies, using the small size recording medium sheets (Step 7). After the completion of the job (Step 8), the control circuit 100 puts the image forming apparatus on standby, and waits for the inputting of the printing start signal for the next printing job (Step 9).

On the other hand, if the control circuit 100 determines in Step 5 that the value belongs to the large size recording medium sheet, it keeps the left and right end cores 39L and 39R in their first position, and makes the image forming apparatus carry out a printing job which outputs a preset number of copies, using the large size recording medium sheets (Step 7). After the completion of the job (Step 8), the control circuit 100 puts the image forming apparatus on standby, and waits for the inputting of the printing start signal for the next printing job (Step 9).

Figure 22:
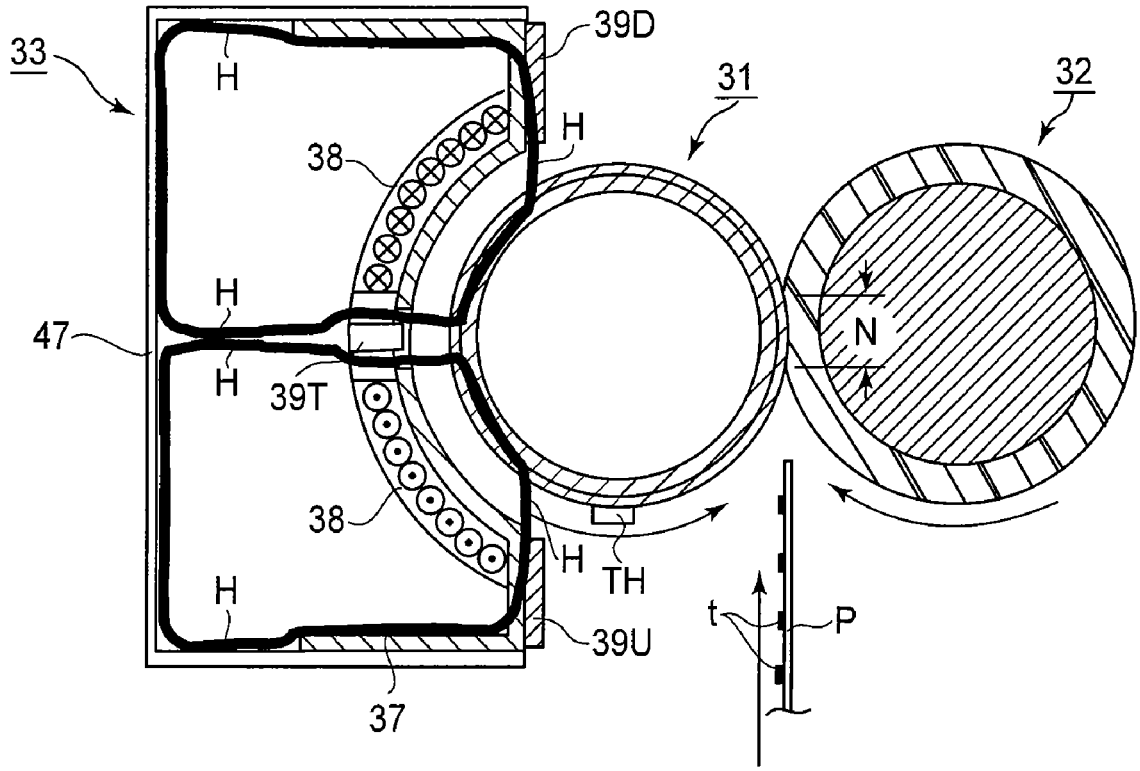
FIG. 22 is a schematic cross-sectional view of the fixing apparatus, and shows the magnetic circuit when the fixing apparatus in the state shown in FIG. 19.

As described above, in the case where the recording medium sheet to be used is the small size recording medium sheet, the left and right end cores 39L and 39R are moved to their second position where they are a preset distance away from the exciter coil 38, as shown in FIGS. 17 and 18. That is, the left and right end cores 39L and 39R are retracted away from the area C, that is, the out-of-path portions of the fixation roller 31. It is in this condition that the pressure roller 32 of the fixing apparatus 20 is driven, and electric power is sent to the exciter coil 38 to carrying out a fixing operation. Shown in a bold line in FIG. 22 is the magnetic circuit made up of the left and right end cores 39L and 39R, and the fixation roller 31 as an inductive heat generating member, around the exciter coil 38. As described above, in the case where the recording medium used for image formation is the small size recording medium sheet, the left and right end cores 39L and 39R remain retracted away from the portions of the fixation roller 31, which correspond to the out-of-path area C, in terms of cross-sectional view. Further, the electrically conductive members 47 are positioned so that they oppose the space created by the movement of the left and right end cores 39L and 3R. Therefore, the magnetic flux H, which is generated around the exciter coil 38 by the cores 39T, 39U, and 39D, and the fixation roller 31 as an inductive heating member, widens. Thus, the magnetic circuit deceases in efficiency, reducing thereby the amount of heat generated. Further, the magnetic flux H from the exciter coil 38 intersects with the electrically conductive members 47. Therefore, the magnetic flux decreases in density, further reducing the amount of heat generated in the portion of the fixation roller 31, which corresponds to the out-of-path area C.

As described above, also in the case of this preferred embodiment, when the small size recording medium sheet is conveyed through the fixing apparatus 20, the above-described the effects A and B are created, and therefore, the amount of temperature increase across the portions of the fixation roller 31, which correspond to the out-of-path areas C, is significantly smaller than that in a fixing apparatus based on the conventional technologies. Further, the fixing apparatus 20 is structured so that only the left and right end cores 39L and 39R are moved (electrically conductive members 47 are not moved). Therefore, it is not overly complicated, and also, relatively small. Further, even if the gap, which forms between the magnetic core 39 and exciter coil 38 as the magnetic core 39 is moved, widens, the presence of the electrically conductive members 47 minimizes the amount of magnetic flux leak, and therefore, minimizes the effects of the magnetic flux upon the components which are in the adjacencies of the apparatus.

Figure 23:
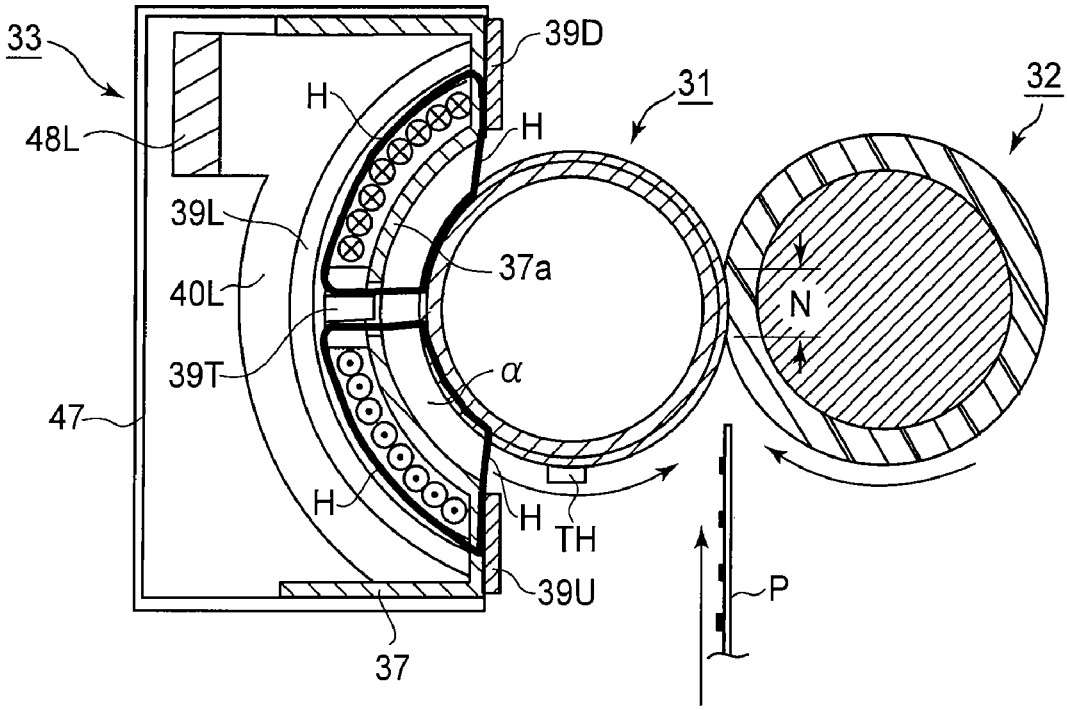
FIG. 23 is a schematic cross-sectional view of the fixing apparatus, and shows the magnetic circuit when the fixing apparatus is in the state shown in FIG. 16.

Referring to FIGS. 14, 15, and 16, in the case where the recording medium used for image formation is the large size recording medium sheet, the left and right end core 39L and 39R are left in, or moved back into, their first position where they are as close as the center core 39C to the exciter coil 38, with the presence of a preset distance from the exciter coil 38. While the fixing apparatus 20 is in this condition, its pressure roller 32 is driven, and the exciter coil 38 is provided with electric power, to carry out a fixing operation. Shown in a bold line in FIG. 23 is the magnetic circuit generated around the exciter coil 38, by the left and right end cores 39L and 39R, and fixation roller 31 as an inductive heat generating member. Therefore, the fixation roller 31 is uniformly heated across its range, which corresponds to the path A of the large size recording medium sheet.

Embodiment 3

In the first preferred embodiment described above, the fixing apparatus 20 was structured to use the electrically conductive members 47. In this embodiment, instead of the electrically conductive members 47, magnetic cores (second magnetic cores) are disposed in the places where the electrically conductive members 47 are in the first preferred embodiment. The size of the magnetic cores (second magnetic cores) in this embodiment is the same as that of the electrically conductive member 47 in the first preferred embodiment. The fixing apparatus in this embodiment is the same in structure as that in the first embodiment, except for the magnetic cores employed in place of the electrically conductive members 47 in the first embodiment. Therefore, the components, portions, etc., of the fixing apparatus in this embodiment, which are the same in structure as those in the first embodiment will not be described here.

Figure 24:
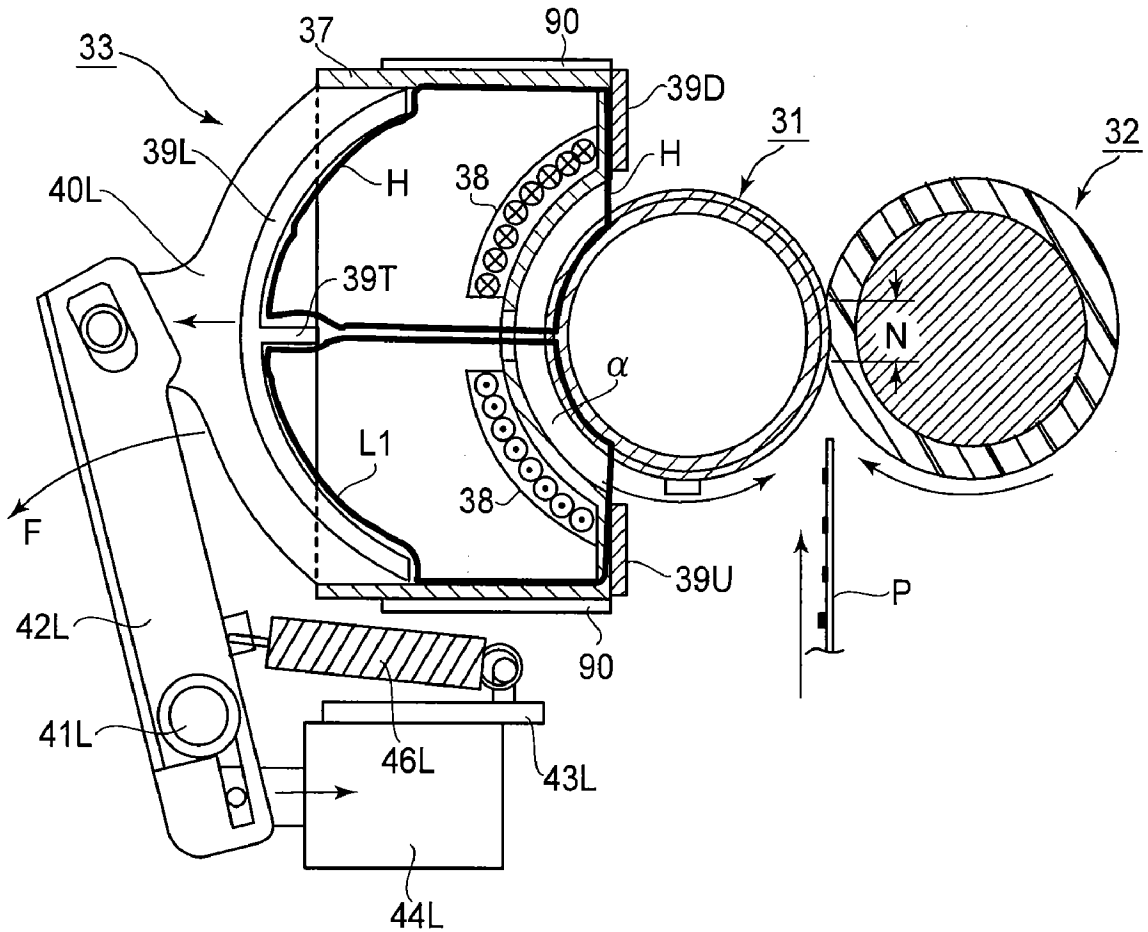
FIG. 24 is a schematic cross-sectional view of the fixing apparatus in the third preferred embodiment of the present invention after the movement of the end portions of the magnetic core of the fixing apparatus.
Figure 25:
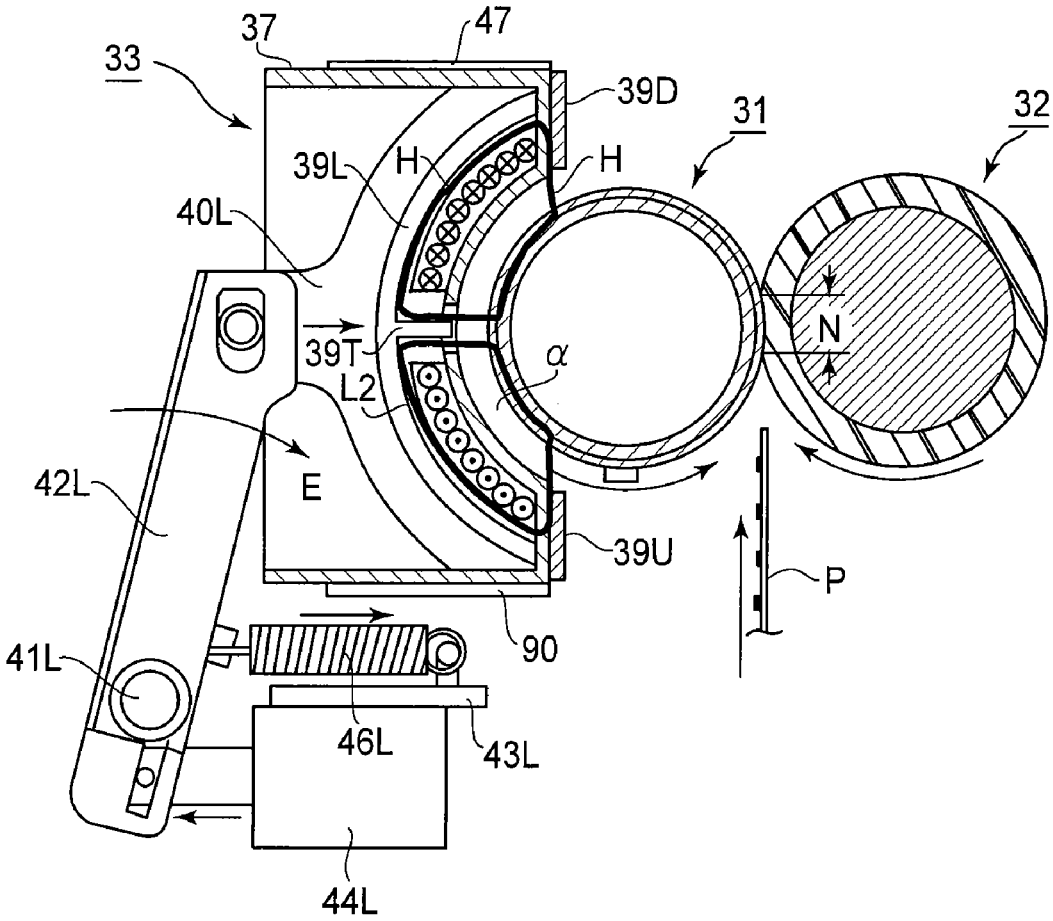
FIG. 25 is a schematic cross-sectional view of the fixing apparatus in the third preferred embodiment of the present invention before the movement of the end portions of the magnetic core of the fixing apparatus.

FIG. 24 is a schematic cross-sectional view of the fixing apparatus in this preferred embodiment of the present invention after the movement of the left and right end cores 39L and 39R. FIG. 25 is a schematic view of the fixing apparatus in this preferred embodiment of the present invention before the movement of the left and right end cores 39L and 39R. In this embodiment, the second magnetic cores 90 are disposed in place of the electrically conductive members 47.

In order to form a stable magnetic circuit, that is, a magnetic circuit whose magnetic field does not leak, the second magnetic cores 90 are made of a magnetic substance which is high in magnetic permeability. Further, in order to prevent the energy loss and heat generation even in high frequency range, the second magnetic cores 9 are made of soft ferrite which is low in residual magnetic flux density, and large in volume resistivity. The size and positioning of the second magnetic cores 90 is the same as those of the electrically conductive members 47 in the first embodiment.

Also in this embodiment, the left and right end cores 39L and 39R are moved as in the first embodiment. As the left and right end cores 39L and 39R are moved, a magnetic circuit L1 is formed as indicated by a bold line in FIG. 24. This magnetic circuit L1 is longer than the magnetic circuit L0 which is formed before the movement of the left and right end cores 39L and 39R. Thus, the portion of the magnetic circuit L1, which acts on the fixation roller 31, is lower in density than the portion of the magnetic circuit L0, which acts on the fixation roller 31. Therefore, as the left and right end cores 39L and 39R are moved as described above, the amount of heat generated by the portions of the fixation roller 31, which correspond to the left and right cores 39L and 39R, decreases.

Figure 26:
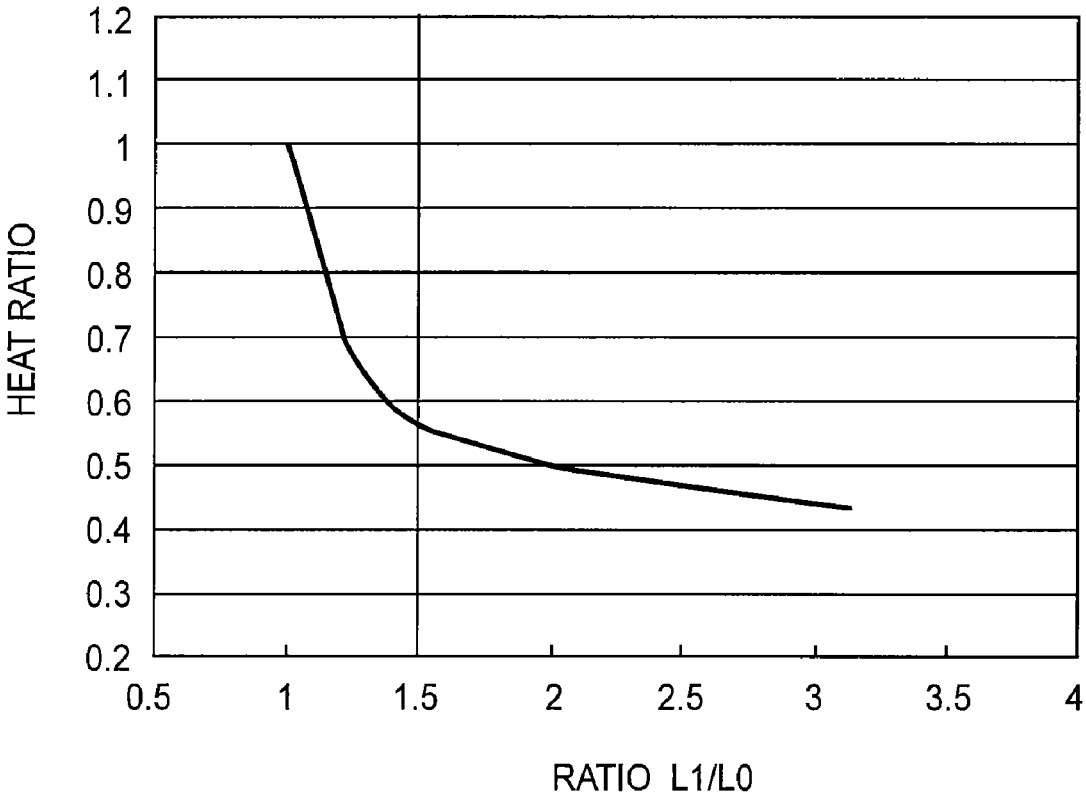
FIG. 26 is a graph which shows the relationship between the change in the length of the magnetic flux and the amount of heat generation.

FIG. 26 is a graph which shows the results of the experiment carried out when the fixing apparatus is in the state shown in FIG. 24, that is, after the core movement. The abscissas represents the ratio L1/L0, that is, the ratio between the length L1 of the portion of the magnetic circuit in the moving areas (out-of-path area E) of the movable portions of the magnetic core assembly, and the length L0 of the portion of the magnetic circuit, which corresponds to the stationary portion of the magnetic core assembly (recording medium path D). The ordinates represents the ratio between the amount of heat generated by the portion of the fixation roller 31 that corresponds to the moving areas of the movable portions of the magnetic core assembly, and the amount of heat generated by the portion of the fixation roller 31 that corresponds to the immovable portion of the magnetic core assembly. It is evident from the result shown in FIG. 26 that as the ratio exceeds 1.5, the effect becomes saturated. The magnetic circuit portion which corresponds to the immovable core assembly portion is equal in length to the magnetic circuit portion L0, that is, the magnetic circuit portion before the movement of the movable portions of the core assembly. Therefore, L1/L0>1. Thus, it is evident that the effect of sufficiently reducing the area corresponding to the sensor 50 in the amount heat generation was achieved.

As described above, not only in the case where the electrically conductive members are employed, but also, in the case where the magnetic cores are employed in place of the electrically conductive members, the amount of leakage of the magnetic flux can be kept small, even if the gap between the magnetic core and the exciter coil is increased by the movement of the magnetic core.

Miscellanies

1) The image forming apparatus and fixing apparatus may be structured so that the recording medium sheet is conveyed in contact with the one of the lateral edges of the recording medium sheet passage of the fixing apparatus.

2) Not only can an image heating apparatus in accordance with the present invention be used as a thermal fixing apparatus, such as those in the preferred embodiments, but also, as an image heating apparatus for improving an image in surface properties, such as glossiness, by heating the recording medium on which the image is present, an image heating apparatus for temporarily fixing an image, or the like image heating apparatus is also present.

As described above, the present invention can maintain a minimization of the amount of leakage of the magnetic flux, even when the gap between the magnetic core and the exciter coil is widened by the movement of the magnetic cores.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 003268/2009 filed Jan. 9, 2009 which is hereby incorporated by reference.

What is claimed is:

1. An image heating apparatus for heating an image on a recording material, said apparatus comprising:

a rotatable heat generation member capable of induction heat generation by a magnetic flux;

a coil, provided outside said heat generation member, for generating the magnetic flux for the induction heat generation;

a movable magnetic core provided at a position opposed to said coil;

a moving device for moving said magnetic core between a first position opposed to said coil and a second position which is more away from said coil than the first position; and an electroconductive member mounted at a position where a magnetic circuit is capable of being formed with said coil when said magnetic core is in the second position.

2. An apparatus according to claim 1, wherein a thickness of said electroconductive member is larger than a skin depth determined by a magnetic permeability of said electroconductive member, a specific resistance of said electroconductive member, and an angular frequency of the magnetic flux generated by said coil.

3. An apparatus according to claim 1, wherein a length of said electroconductive member measured in a movable direction of said magnetic core is larger than a movable distance of said magnetic core.

4. An apparatus according to claim 1, wherein said electroconductive member is disposed in a region opposed to said magnetic core with respect to a direction of a rotational axis of said induction heat generation member.

5. An apparatus according to claim 1, wherein said electroconductive member extends in parallel with a moving direction of said magnetic core.

6. An apparatus according to claim 1, wherein a magnetic path formed by said magnetic core, said coil, said heat generation member and said electroconductive member is longer when said magnetic core is in the first position than when said magnetic core in the second position.

7. An image heating apparatus for heating an image on a recording material, said apparatus comprising:

a rotatable heat generation member capable of induction heat generation by a magnetic flux;

a coil, provided outside said heat generation member, for generating the magnetic flux for the induction heat generation;

a movable first magnetic core provided at a position opposed to said coil;

a moving device for moving said first magnetic core between a first position opposed to said coil and a second position which is farther away from said coil than the first position; and a second magnetic core mounted at a position where a magnetic circuit is capable of being formed with said coil when said first magnetic core is in the second position.

8. An apparatus according to claim 7, wherein said second magnetic core is stationary.

9. An apparatus according to claim 7, wherein a length of said second magnetic core measured in a movable direction of said first magnetic core is larger than a movable distance of said first magnetic core.

10. An apparatus according to claim 7, wherein said second magnetic core is disposed in a region opposed to said first magnetic core with respect to a direction of a rotational axis of said induction heat generation member.

11. An apparatus according to claim 7, wherein a magnetic path formed by said first magnetic core and said heat generation member when said first magnetic core is in the first position is longer than the magnetic path formed by said first magnetic core, said induction heat generation member and said second magnetic core when said first magnetic core in the second position.

12. An apparatus according to claim 11, wherein a magnetic path L0 formed by said first magnetic core and said heat generation member when said first magnetic core is in the first position and a magnetic path L1 formed by said first magnetic core, said heat generation member and said second magnetic core satisfy L1/L0>1.50.

* * * * *